US010829975B2

(12) United States Patent
Wu

(10) Patent No.: US 10,829,975 B2
(45) Date of Patent: Nov. 10, 2020

(54) ANGLE-ADJUSTABLE POSITIONING AND SELF-CLOSING HINGE FOR HIGHLY SEALED DOOR

(71) Applicant: TONGGUAN (XIAMEN) ELECTRONIC TECHNOLOGY CO., LTD., Xiamen, Fujian Province (CN)

(72) Inventor: Yulong Wu, Xiamen (CN)

(73) Assignee: TONGGUAN (XIAMEN) ELECTRONIC TECHNOLOGY CO., LTD., Xiamen (CN)

( * ) Notice: Subject to any disclaimer, the term of this patent is extended or adjusted under 35 U.S.C. 154(b) by 168 days.

(21) Appl. No.: 15/764,783

(22) PCT Filed: Sep. 28, 2016

(86) PCT No.: PCT/CN2016/100555
§ 371 (c)(1),
(2) Date: Mar. 29, 2018

(87) PCT Pub. No.: WO2017/054728
PCT Pub. Date: Apr. 6, 2017

(65) Prior Publication Data

US 2018/0291663 A1 Oct. 11, 2018

(30) Foreign Application Priority Data

Sep. 29, 2015 (CN) ..... 2015 1 0631334
Sep. 29, 2015 (CN) ..... 2015 2 0761852 U
Aug. 31, 2016 (CN) ..... 2016 1 0794539

(51) Int. Cl.
*E05F 1/06* (2006.01)
*E05F 1/12* (2006.01)
(Continued)

(52) U.S. Cl.
CPC ..... *E05F 1/066* (2013.01); *E05D 11/1078* (2013.01); *E05F 1/1223* (2013.01);
(Continued)

(58) Field of Classification Search
CPC ..... E05F 1/066; E05F 1/1223; E05F 3/20; E05D 11/1078; E05D 11/06
See application file for complete search history.

(56) References Cited

U.S. PATENT DOCUMENTS 6,205,619 B1 * 3/2001 Jang ..... E05D 5/10 16/352
8,015,665 B2 * 9/2011 Pan ..... E05F 1/1008 16/308

(Continued)

*Primary Examiner* — Victor D Batson
*Assistant Examiner* — Matthew J Sullivan
(74) *Attorney, Agent, or Firm* — Bayramoglu Law Offices LLC

(57) ABSTRACT

Provided is an angle-adjustable positioning and self-closing hinge for a highly sealed door, comprising a hinge part, a fixing base, a fixing bar, a threaded sleeve, a threaded ring, a plug, and an adjustment socket; the hinge part is provided with a bushing and a leaf; the fixing base is provided with a bushing; the fixing bar has a screw; a threaded sleeve is fastened inside the bushing, the plug is fastened inside the bushing, and the threaded sleeve and plug are spaced apart; between the threaded sleeve and plug in the two bushings are disposed the fixing bar, the two magnets, two springs, and the adjustment base; the screw of the fixing bar is screwed to the threaded sleeve.

13 Claims, 12 Drawing Sheets

(51) Int. Cl.

| | |
|---|---|
| ***E05D 11/10*** | (2006.01) |
| ***E05F 3/20*** | (2006.01) |
| *E05D 11/06* | (2006.01) |

(52) U.S. Cl.

CPC ..... *E05F 3/20* (2013.01); *E05D 11/06* (2013.01); *E05D 2011/1092* (2013.01); *E05Y 2201/46* (2013.01); *E05Y 2201/696* (2013.01); *E05Y 2201/702* (2013.01); *E05Y 2600/12* (2013.01); *E05Y 2800/75* (2013.01); *E05Y 2900/102* (2013.01); *E05Y 2900/132* (2013.01); *E05Y 2900/30* (2013.01); *E05Y 2900/514* (2013.01); *E05Y 2900/608* (2013.01)

(56) References Cited

U.S. PATENT DOCUMENTS

| | | | | |
|---|---|---|---|---|
| 9,152,183 | B2 * | 10/2015 | Kurczewski | G06F 1/1681 |
| 2007/0157432 | A1 * | 7/2007 | Weinstein | E05D 11/00 16/320 |
| 2018/0223574 | A1 * | 8/2018 | Babikian | E05D 3/02 |
| 2018/0238092 | A1 * | 8/2018 | Feng | E05F 3/20 |
| 2019/0040667 | A1 * | 2/2019 | Feng | E05D 3/02 |

* cited by examiner

ANGLE-ADJUSTABLE POSITIONING AND SELF-CLOSING HINGE FOR HIGHLY SEALED DOOR

CROSS REFERENCE TO RELATED APPLICATIONS

The present application is the US national stage of International Patent Application PCT/CN2016/100555 filed on Sep. 28, 2016, which, in turn, claims priority to Chinese Patent Application CN 201610794539.8 filed on Aug. 31, 2016, to Chinese Patent Application CN 201510631334.3 filed on Sep. 29, 2015, and to Chinese Patent Application CN 201520761852.2 filed on Sep. 29, 2015.

FIELD

The present disclosure relates to an angle-adjustable positioning and self-closing hinge for a highly sealed door.

BACKGROUND

A patent of utility model entitled "Hinge Ascending and Descending Device", with patent No. 2013208356551, is published by CNPAT. The device includes an upper hinge, a lower hinge, a transmission seat and a transmission rod, wherein the upper hinge comprises an upper bushing and an upper hinge sheet fixedly connected to the upper bushing, the lower hinge comprises a lower bushing and a lower hinge sheet fixedly connected to the lower bushing, the transmission seat is fixedly connected with the upper bushing, the bottom end face of the transmission seat is concavely provided with a transmission cavity, a rotative surface in the transmission cavity is provided with a first spiral part, the transmission rod is fixedly connected with the lower bushing, a rotative surface outside the transmission rod is provided with a second spiral part, the transmission rod is connected with the transmission cavity, the first spiral part and the second spiral part are meshed in a matching manner, when the upper hinge is pushed for rotating relative to the lower hinge, the upper hinge may ascend through the matching of the first spiral part and the second spiral part, and when the pushing is released, the upper hinge is enabled to be descended under the action of gravity, and the upper hinge may automatically reset to be closed through the matching of the first spiral part and the second spiral part. The ascending and descending device realizes rotation and connection directly through upper bushing lower bushing, which is poor in practicality when applied to a highly sealed door, and there is a possibility of air leakage.

SUMMARY

The present disclosure provides a highly sealed door which may adjust angle positioning of a hinge part and self-close a hinge, overcoming the disadvantages of the ascending and descending device in background.

Technical solution 1 for solving the technical problem of the present disclosure is:

An angle-adjustable positioning and self-closing hinge for a hermetically sealed door includes a hinge part, a fixing base, a fixing bar, a threaded ring and a threaded sleeve having interior threads, a connecting sleeve, a plug, and an adjustment base. The hinge part is provided with a bushing, and a leaf is fastened to an exterior of the bushing. The fixing base is provided with another bushing. The hinge part is rotatable relative to the fixing base, and the fixing bar has an outwardly extending screw portion with threads. The threaded sleeve resides in the bushing, and the plug is adjustably secured in the another bushing. The first magnet, a second magnet, a first spring, a cup body, a second spring and an adjustment base are coaxially arranged in the connecting sleeve between the threaded sleeve and the plug on a long axis of the hinge, and the threaded sleeve receives the screw portion of the fixing bar to secure the hinge together. The first spring abuts between the fixing bar and a front end face of the cup body, and the first magnet is axially movable with the fixing bar. The second spring abuts the plug at one end and abuts the second magnet at the other end. The second magnet is axially movable relative to the plug. The first magnet and the second magnet are arranged in the sleeve such that a magnetic force attracts each of the magnets toward the other. The adjustment base is rotated accordingly to move the plug and the bottom of the cup body to and fro along the axis thus adjusting and reducing separation distance between positions of the second magnet and the plug.

The hinge includes a first screw and a second screw. The first screw and the second screw each has a smooth section and a threaded section at an end. The smooth section of the first screw passes through the first magnet. The threaded section of the first screw is screwed on the fixing bar and a screw head of the first screw is supported at the first magnet. The smooth section of the second screw passes through the second magnet. The threaded section of the second screw is screwed on the plug, and a screw head of the second screw is supported at the second magnet.

The adjustment base is a third screw threaded through the plug and abutting against the bottom of the cup body.

The second spring and the second magnet are contained in the cup body, and the second magnet and the cup body move together as a single unit on the axis. A lower portion of the first magnet is contained in and moves axially with the cup body.

An annular protruding ring secures the protruding ring to the connecting bar. The first spring is fitted over the connecting bar and seats against the protruding ring at one end and against a pad, or O-ring, positioned on a front outer edge of the cup body at another end.

The second spring is positioned to constantly urge the protruding ring of the fixing bar and the first magnet apart. The first screw passes through an inner ring through hole of the first magnet, an inner ring through hole of a pad, or O-ring and the second spring and is threadedly secured to the connecting bar. The second magnet is positioned on a pad for adjustment of a leaf positioning angle. The second screw passes through an inner ring through hole of the second magnet and an inner ring through hole of the pad and is threadedly secured to the adjustment base, such that the second magnet and the adjustment base are fastened together. An annular protruding ring secures the protruding ring to the connecting bar to define a protruding ring. An annular groove is formed at an outer ring in the annular protruding ring. An O-ring resides in the annular groove to seal and contact an interior wall of the connecting sleeve for sliding engagement with the wall to generate sealing damping force and resistance force in the connecting sleeve thus improving the damping force and the resistance force generated by up and down sliding and movement of the annular protruding ring within the connecting sleeve.

Technical solution 2 for solving the technical problem of the present disclosure is: An angle-adjustable positioning and self-closing hinge for a highly sealed door, comprising a hinge part, a fixing base, a fixing bar and a threaded sleeve, the hinge part being provided with a bushing and a leaf fastened outside the bushing, the threaded sleeve having a thin bar which constitutes the leaf, the threaded sleeve being rotatably arranged in the bushing, the leaf being rotatable relative to the fixing bar and the fixing base, and the fixing bar having a screw; and characterized in that: the angle-adjustable positioning and self-closing hinge further comprises a plug and an adjustment base, the threaded sleeve is fastened inside one end of the bushing, the plug is fastened inside the other end the bushing, and the threaded sleeve and plug are spaced apart; a fixing bar, a threaded ring, a first magnet, a second magnet, a first spring, a cup body and a second spring are provided between the threaded sleeve and plug in the bushing, the screw of the fixing bar is screwed to the threaded sleeve, a first spring abuts between the fixing bar and the first magnet, the first magnet is movable relative to the fixing bar, the second spring abuts relative to the plug at one end and abuts the second magnet at the other end, the second magnet is movable relative to the plug, the first magnet and second magnet are magnetically attracted to each other, and the adjustment base is adjusted and rotated to correspondingly cooperate with the second magnet, the plug and the bottom of the cup body, thereby adjusting and reducing separation distance between positions of the second magnet and the plug; the adjustment base is adjusted and rotated to correspondingly cooperate with the second magnet, the plug and the bottom of the cup body, thereby adjusting and reducing separation distance between positions of the second magnet and the first magnet; wherein, the fixing bar has a protruding ring, a sliding track groove is concavely arranged on a side of an outer ring of the protruding ring, and an inner ring flange of the threaded ring is convexly arranged on a front edge of an inner circumference passing through a through hole of the threaded ring, such that the inner ring flange of the threaded ring abuts inside the sliding track groove of the protruding ring, and the sliding track groove of the protruding ring correspondingly fits the inner ring flange of the threaded ring, so as to control and position axial and circumferential separation distance of the fixing bar in sliding and moving along an axis up and down relative to the threaded sleeve, and to correspondingly cooperate with the leaf of the hinge part to predetermine a positioning angle.

The technical solution compared with the background technology has the advantages provided as follows.

The fixing bar, the threaded ring, two magnets, two springs and the adjustment base are arranged between the threaded sleeve and the plug. The threaded sleeve and the screw in the connecting sleeve of two bushings may be relatively rotated when the two bushings are relatively rotated, such that the two or more of six straight-inclination-pitch protruding helical teeth of the screw of the fixing bar are capable of sliding downwards in the axial direction with two or more of six straight-inclination-pitch recessed helical teeth in the threaded sleeve, such that the six straight-inclination-pitch protruding helical teeth of the screw can slide and move downwards along the axis relative to the six straight-inclination-pitch recessed helical teeth in the threaded sleeve, and such that the threaded sleeve and screw may be moved up and down along the axis within a preset angle of the rotation of hinge part. The fixing bar bears a balanced abutting force transformed from magnetic force of two magnets and elastic force of the first spring, thus the leaf of the hinge part may be self-positioned within the rotating preset positioning angle and meanwhile realize self-closing at other angles for friendly use. The adjustment base is adjusted and rotated to correspondingly cooperate with the second magnet, the plug and the bottom of the cup body, thereby adjusting and reducing the separation distance between the positions of the second magnet and the plug, such that the second magnet and the first magnet may be magnetically attracted to each other and positioned together in the connecting sleeve, and such that the adjustment base may correspondingly cooperate with the predetermined positioning angle of the leaf of the hinge part, such that the hinge part may self-position at the start point positions of any preset angle between predetermined positioning angles, and the hinge part may self-close at a boundary point below a position start point of the predetermined positioning angles, i.e., the hinge part self-positions at the start point positions of a single preset angle of the predetermined positioning angles, and the leaf of the hinge part may realize the function of self-closing at the boundary point below a position start point of the predetermined positioning angles. The adjustment base is adjusted and rotated to correspondingly and flexibly cooperate with the second magnet, the plug and the bottom of the cup body, thereby adjusting and reducing the separation distance between the positions of the second magnet and the first magnet, such that the second magnet and the first magnet may be magnetically attracted to each other and positioned together in the connecting sleeve, and such that the adjustment base may correspondingly cooperate with the hinge part to position itself at a needed predetermined angle, such that the hinge part may self-position at the start point positions of any preset angle within the predetermined positioning angles, and the hinge part may close itself at a position below a position start point of self-positioned location at any predetermined angle position.

BRIEF DESCRIPTION OF THE DRAWINGS

The present disclosure will be further presented with reference to the drawings and embodiments.

DETAILED DESCRIPTION

Embodiment 1

Figure 1:
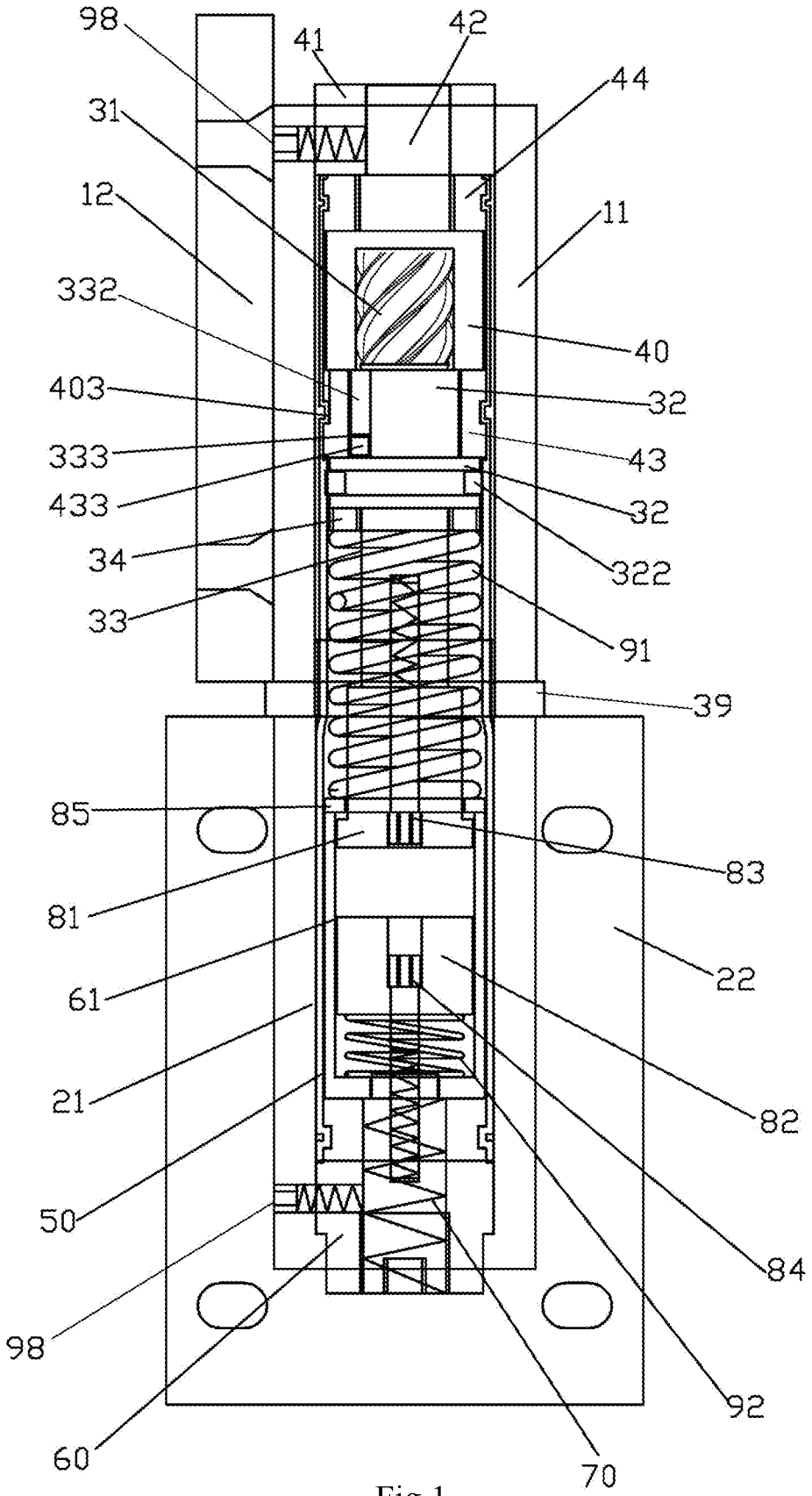
FIG. 1 illustrates a schematic view of a hinge according to Embodiment 1.
Figure 2:
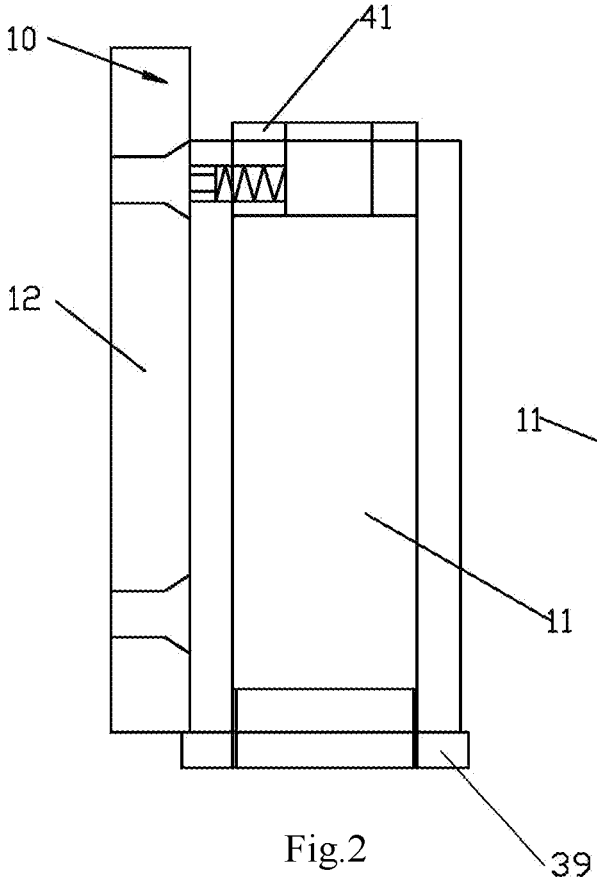
FIG. 2 illustrates a schematic view of a hinge part according to Embodiment 1.
Figure 3:
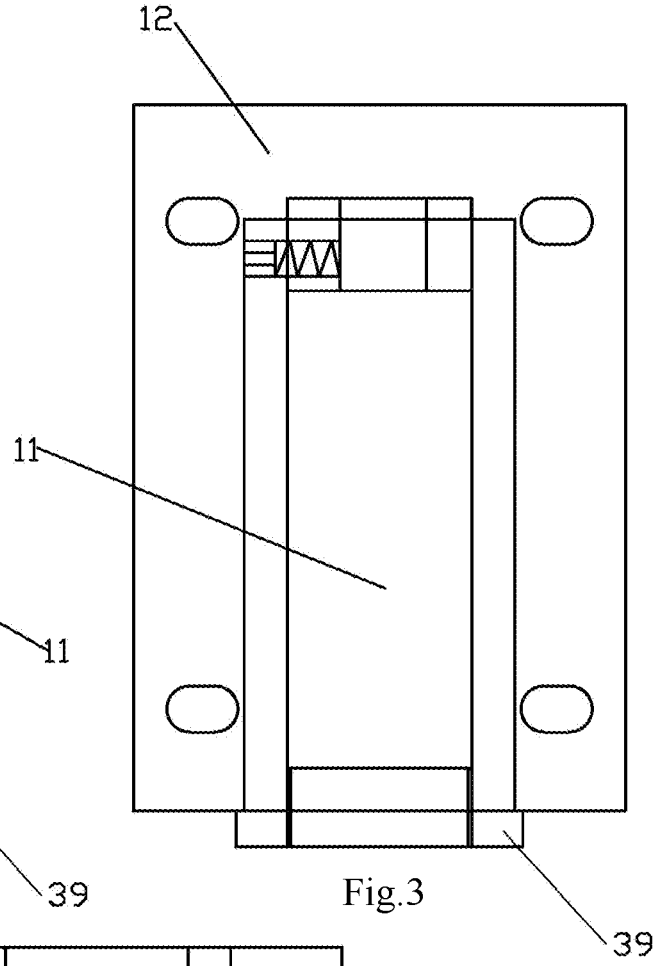
FIG. 3 illustrates a schematic view of a leaf of the hinge part according to Embodiment 1.
Figure 4:
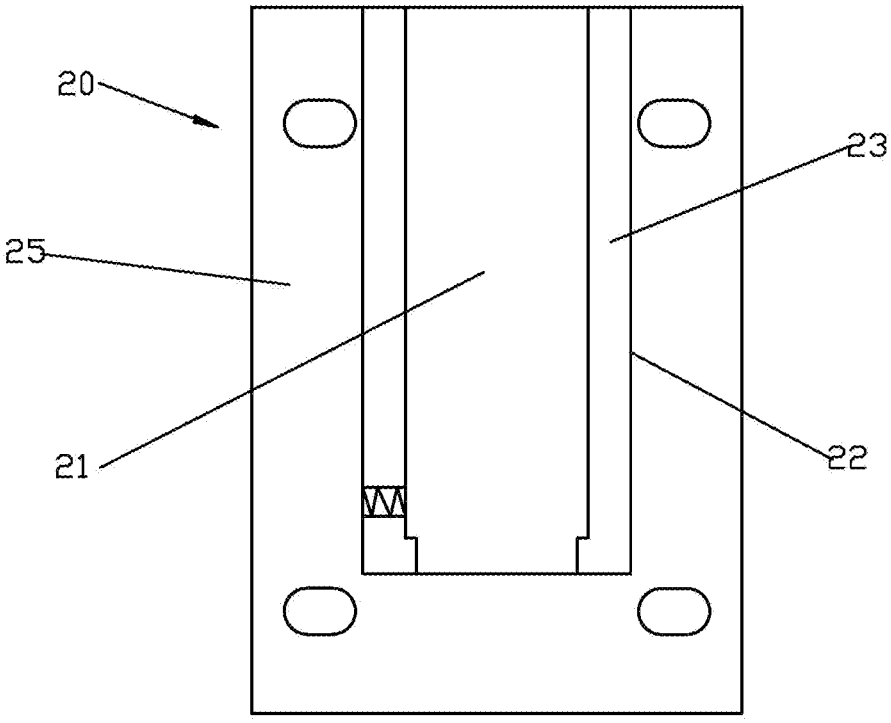
FIG. 4 illustrates a schematic view of a fixing base according to Embodiment 1.
Figure 5:
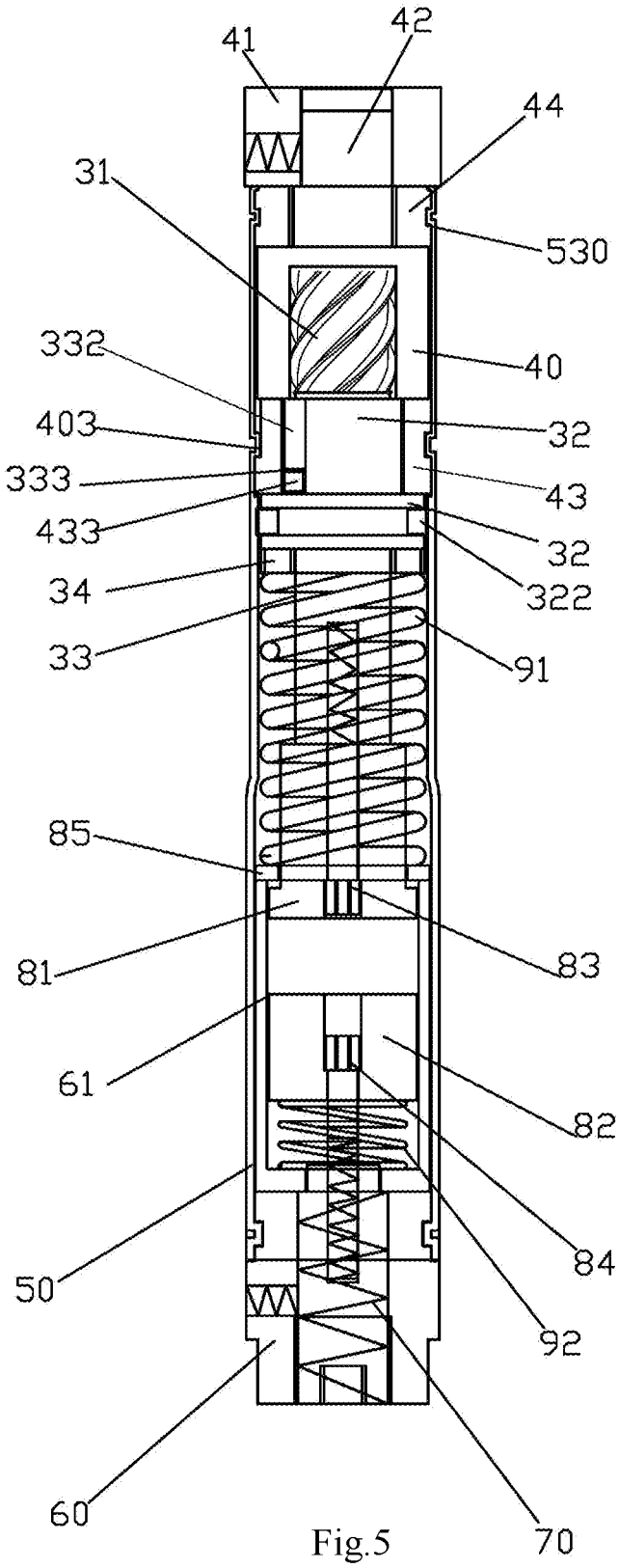
FIG. 5 illustrates a schematic view of an assembled connecting sleeve according to Embodiment 1.
Figure 6:
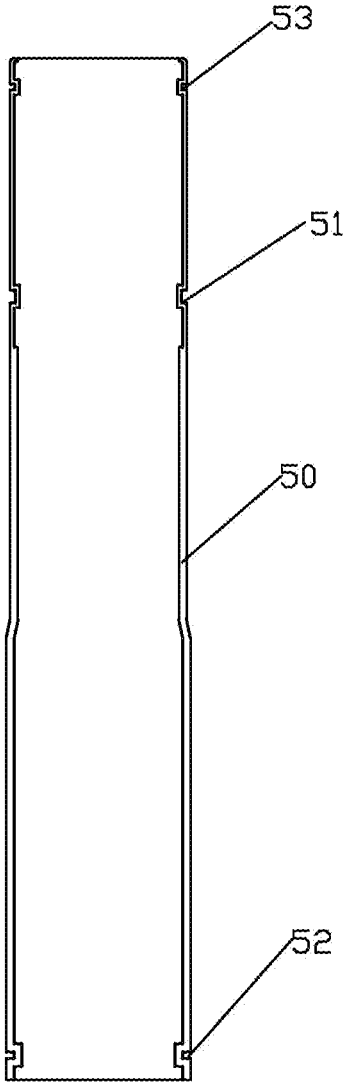
FIG. 6 illustrates a schematic view of the connecting sleeve according to Embodiment 1.
Figure 7:
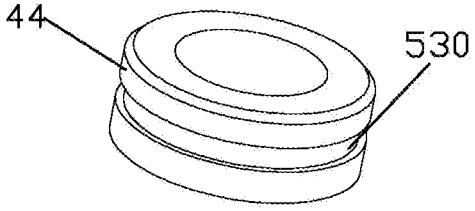
FIG. 7 illustrates a schematic view of a first bearing according to Embodiment 1.
Figure 8:
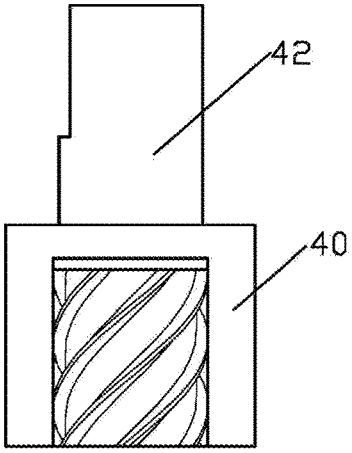
FIG. 8 illustrates a schematic view of a threaded sleeve according to Embodiment 1.
Figure 9:
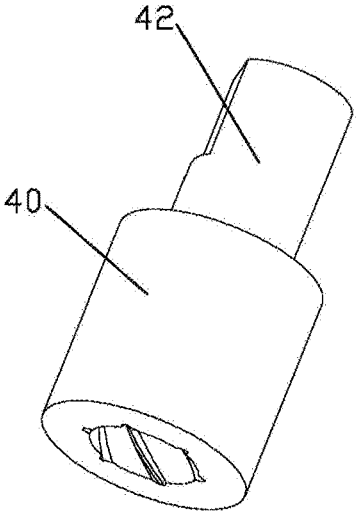
FIG. 9 illustrates a perspective view of the threaded sleeve according to Embodiment 1.
Figure 10:
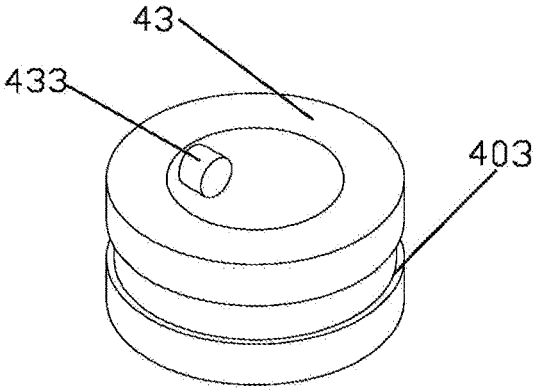
FIG. 10 illustrates a perspective view of a threaded ring according to Embodiment 1.
Figure 14:
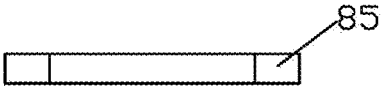
FIG. 14 illustrates a schematic view of a pad according to Embodiment 1.
Figure 13:
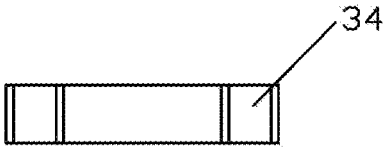
FIG. 13 illustrates a schematic view of a second bearing according to Embodiment 1.
Figure 11:
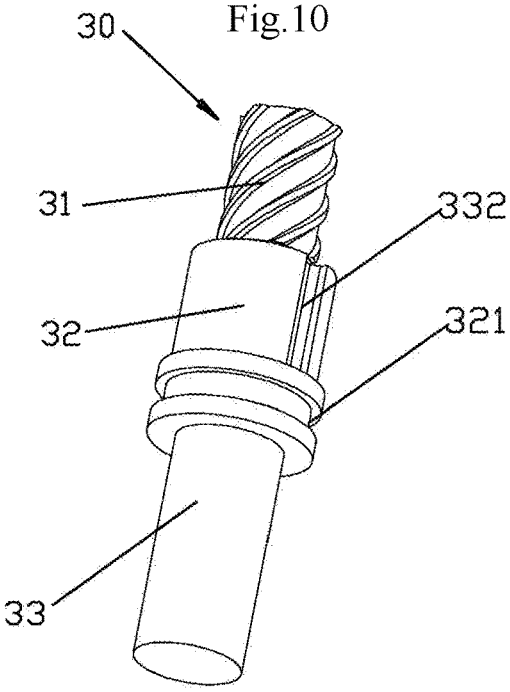
FIG. 11 illustrates a perspective view of a fixing bar according to Embodiment 1.
Figure 12:
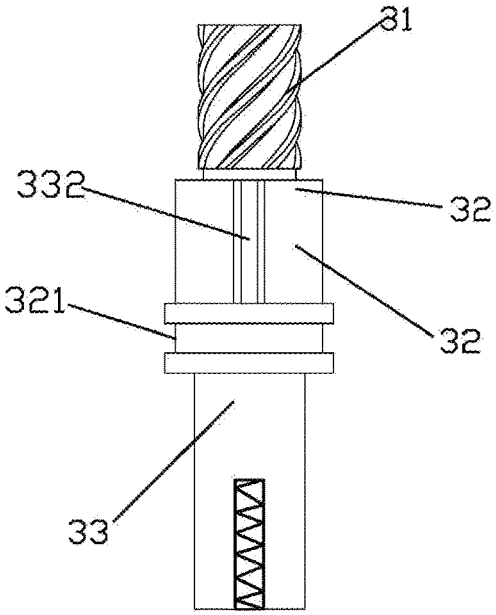
FIG. 12 illustrates a schematic view of the fixing bar according to Embodiment 1.
Figure 15:
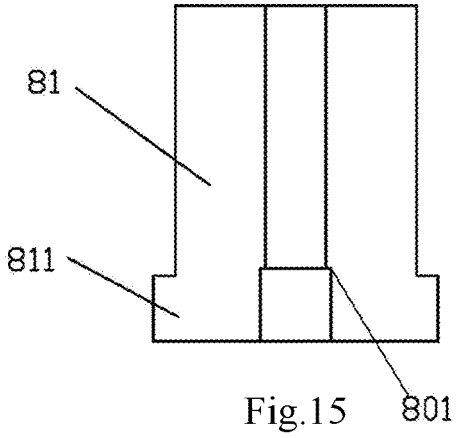
FIG. 15 illustrates a schematic view of a first magnet according to Embodiment 1.
Figure 16:
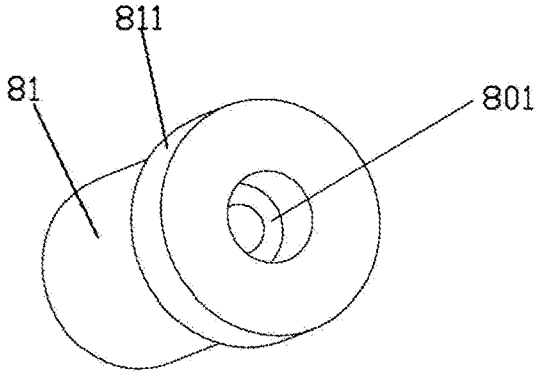
FIG. 16 illustrates a perspective view of the first magnet according to Embodiment 1.
Figure 17:
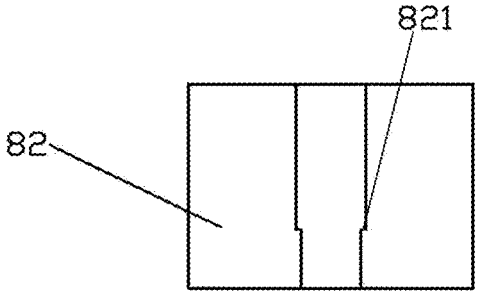
FIG. 17 illustrates a schematic view of a second magnet according to Embodiment 1.
Figure 18:
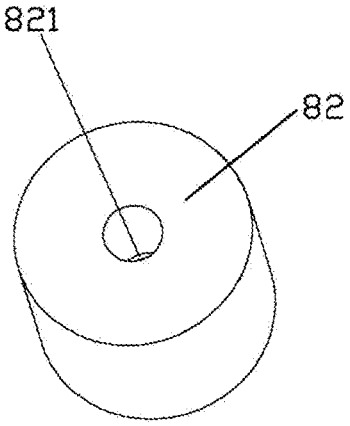
FIG. 18 illustrates a perspective view of the second magnet according to Embodiment 1.
Figure 19:
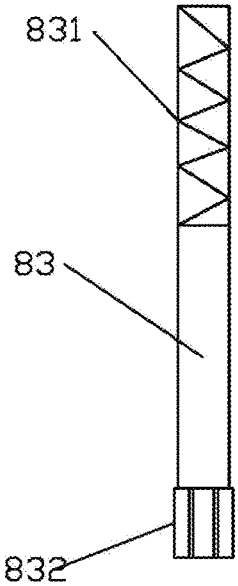
FIG. 19 illustrates a schematic view of a first screw according to Embodiment 1.
Figure 20:
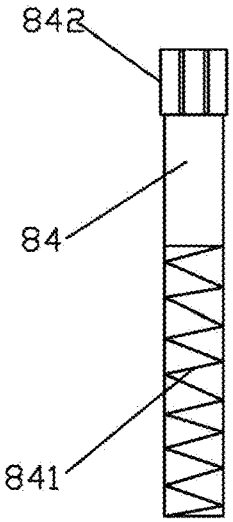
FIG. 20 illustrates a perspective view of a second screw according to Embodiment 1.
Figure 21:
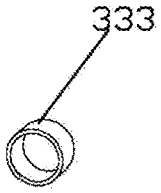
FIG. 21 illustrates a perspective view of a sliding sleeve according to Embodiment 1.
Figure 22:
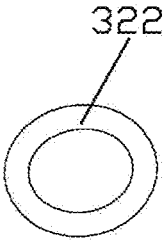
FIG. 22 illustrates a perspective view of a rubber sealing ring according to Embodiment 1.
Figure 23:
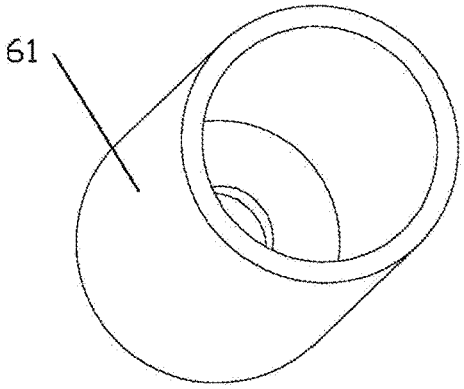
FIG. 23 illustrates a perspective view of a cup body according to Embodiment 1.
Figure 24:
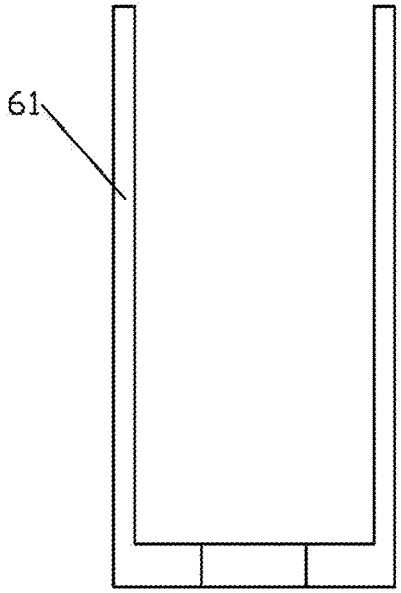
FIG. 24 illustrates a schematic view of the cup body according to Embodiment 1.
Figure 25:
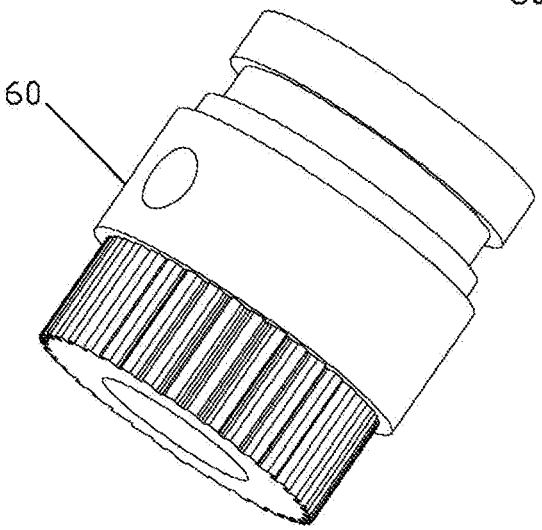
FIG. 25 illustrates a perspective view of a plug according to Embodiment 1.
Figure 26:
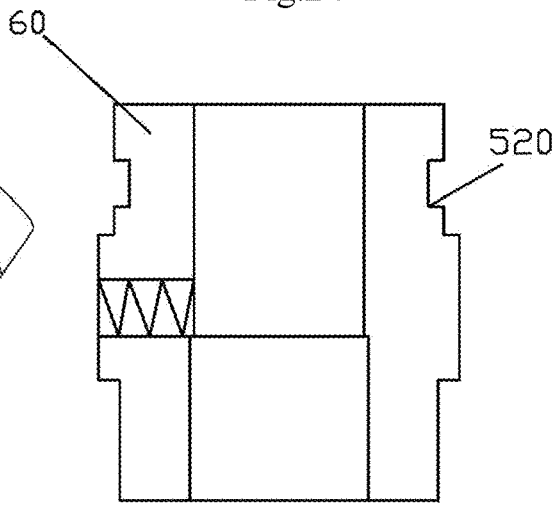
FIG. 26 illustrates a schematic view of the plug according to Embodiment 1.
Figure 27:
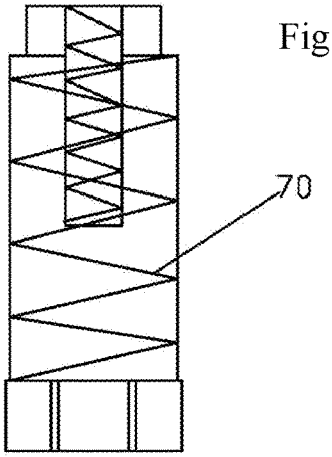
FIG. 27 illustrates a schematic view of an adjustment base according to Embodiment 1.
Figure 28:
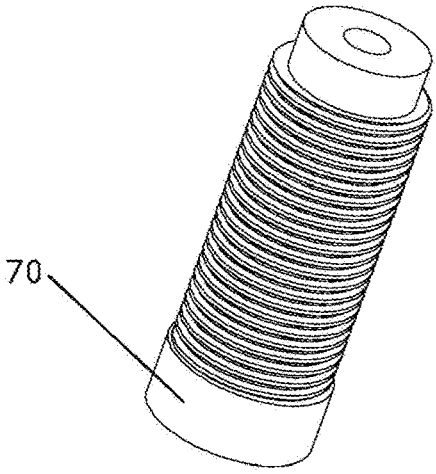
FIG. 28 illustrates a perspective view of the adjustment base according to Embodiment 1.
Figure 29:
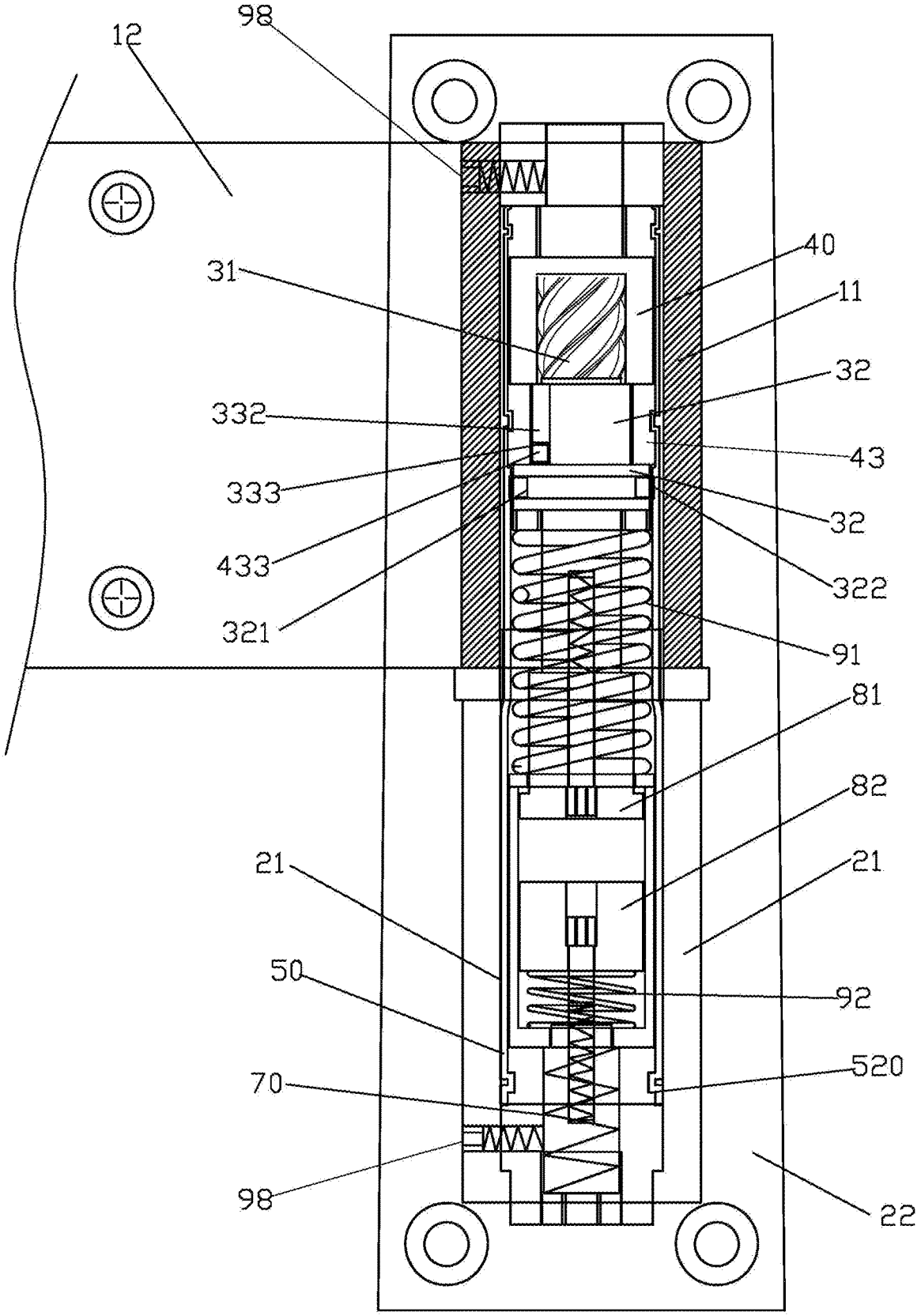
FIG. 29 illustrates a schematic view of a hinge according to Embodiment 2.
Figure 30:
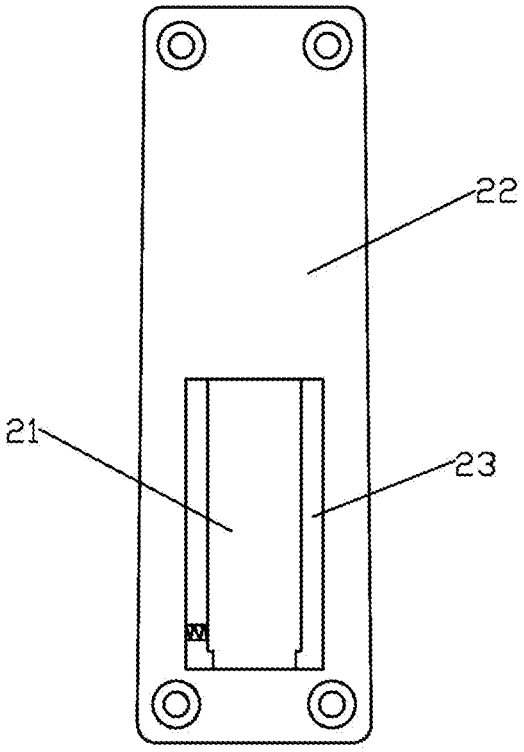
FIG. 30 illustrates a schematic view of a bottom plate and a protruding seat according to Embodiment 2.
Figure 31:
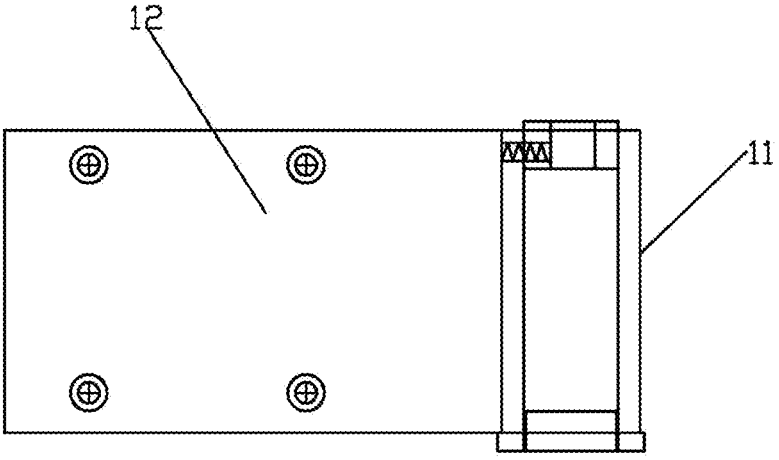
FIG. 31 illustrates a schematic view of a leaf of a bushing of the hinge part according to Embodiment 2.
Figure 32:
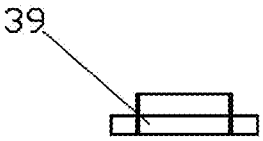
FIG. 32 illustrates a schematic view of a third bearing according to Embodiment 2.
Figure 33:
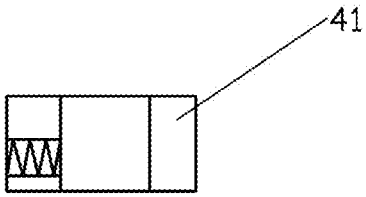
FIG. 33 illustrates a schematic view of a swivel according to Embodiment 2.

An angle-adjustable positioning and self-closing hinge for a highly sealed door has a predetermined positioning angle ranging from 20 to 180 degrees. Within the range (20 to 180 degrees) of the predetermined positioning angle, a leaf of the hinge part may position itself at a start point of any one predetermined positioning angle, and at the start point of any one predetermined positioning angle, a position where the leaf of the hinge part can positioned itself is below the start point, such that the leaf of the hinge part closes itself. The angle-adjustable positioning and self-closing hinge for a highly sealed flat door and an angle-adjustable positioning and self-closing hinge for a highly sealed convex door are hinges for a highly sealed flat door and a highly sealed convex door which are suitable for applying to doors, such as doors of a freezer, a fridge, a refrigerator, an oven, an oven test equipment, a test chamber door, a simulated environment test equipment door, a mechanical equipment door, a drying equipment door, a sound-proof door, a special door, a preservative storage door, a tea storehouse door, a civil storehouse door and any ship door.

As shown in FIG. 1 to FIG. 28, the hinge includes a hinge part 10, a fixing base 20, a fixing bar 30, a threaded sleeve 40, a threaded ring 43, a connecting sleeve 50, a plug 60, and an adjustment base 70.

The hinge part 10 includes a bushing 11 and a leaf 12 fastened outside the bushing 11. The fixing base 20 includes a fixing plate 25, a vertical bottom plate 22, and a protruding seat 23 fastened to the bottom plate 22. A bushing 21 is recessed in an end face of the vertical base plate 22 of the protruding seat 23. A connecting sleeve 50 is connected in the bushing 11 and the bushing 21 of the protruding seat 23. A third bearing 39 is rotatably sleeved between a circumferential plane of an end of the busing 11 and a circumferential plane of an end of the bushing 21 of the protruding seat 23. The third bearing 39 may also be rotatably fitted over the connecting sleeve 50, such that the hinge part 10 rotates more smoothly with respect to the axis of the fixing base 20. The busing 11 and the bushing 21 are arranged abreast, such that the leaf of the hinge part may rotate relative to the bushing 21 of the protruding seat 23, and the hinges may constitute the structure of an angle-adjustable positioning and self-closing hinge for a highly sealed flat door or convex door.

The threaded sleeve 40 may be rotatably and non-slidably connected in a connecting sleeve 50 in the busing 11, and a rotary ring 41 in the busing 11 of the hinge part 10 is fixedly connected to a portion of a thin rod 42, protruding out of the connecting sleeve 50, of the threaded sleeve 40, the fixed connection is provided with the rotary ring 41, and the thin rod 42 is arranged on and protrudes from an upper part of the threaded sleeve 40. The thin rod 42 of the threaded sleeve 40 may rotatably pass through a through hole of the first bearing 44 and a through hole of the rotary ring 41. The rotary ring 41 fits on the upper part of the busing 11, a fixing screw 98 is provided, and the fixing screw 98 is screwed into and pass through the through hole of the busing 11, then is locked into and passes through the rotary ring 41 and further locked in the thin rod, such that the busing 11, the rotary ring 41 and the thin rod are fixed together, as to position the axial and circumferential separation distance of the fixing rod when sliding and moving along an axis up and down relative to the threaded sleeve, and such that the leaf of the hinge part can predetermine a positioning angle freely. The rotary ring 41 and the busing 11 also limit and control the axial movement of the threaded sleeve 40. The connecting sleeve 50 is provided with a second flange 52 therein, the second flange 52 in the connecting sleeve 50 can abut against a ring groove 520 of a plug 60, such that in the connection sleeve 50, the second flange 52 can be inserted in the ring groove 520 of the plug 60, and the plug 60, the second flange 52 and the connecting sleeve 50 may be connected and fixed in the connecting sleeve 50. As to a part of the plug 60 protruding out of the connecting sleeve 50, a fixing screw 98 is screwed into and passes through a screw through hole of the bushing 21, then is locked into and fixedly connected to the plug 60, and then is screwed into, locked to and fixed with the adjustment base 70. Meanwhile, firstly the fixing screw 98 is not locked and fastened to the adjustment base 70 by cooperating with the bushing 21 and the plug 60, after that the adjustment base 70 is adjusted and rotated to correspondingly fit the plug 60, a second magnet 82 and a bottom of the cup body 61, thereby adjusting and reducing the separation distance between positions of the second magnet 82 and a first magnet 81, such that the second magnet and the first magnet are magnetically attracted and located in the connecting sleeve 50 together, and an adjustment base can correspondingly fit and adjust the leaf of the hinge part, after self position at a required positioning angle within a predetermined angle, the standby the fixing screw 98 is again activated to lock and fasten the adjustment base 70, so as to prevent the adjustment base from loosening. The threaded sleeve and plug are spaced apart, and a fixing bar 30, a threaded ring 43, a first magnet 81, a second magnet 82, a cup body 61, a pad 85, a first spring 91 and a second spring 92 are arranged between the threaded sleeve and plug in the connecting sleeve, and the fixing bar 30 has a screw 31. Teeth of the screw 31 of the fixing bar 30 fits teeth of the threaded sleeve 40, such that the screw 31 of the fixing bar 30 may slide and move up and down along an axis with respect to the threaded sleeve 40. The fixing bar 30 has a protruding ring 32 fixed to the end provided with the screw 31, protruding ring 32 is fixedly connected with an annular protruding ring 32, and the annular protruding ring 32 is fixedly connected with a connecting bar 33, and the screw 31 is screwed to the threaded sleeve 40. The first spring 91 abuts between the fixing bar 30 and the pad 85 at a front end face of the cup body 61. The first magnet 81 is fixedly connected to the connecting bar 33 and may slide and move along with the fixing bar 30 up and down along the bushing. An end of the second spring 92 may relatively abut against a bottom of the cup body 61 and the plug 60, and another end of the second spring 92 abuts against the second magnet 80, and the second magnet 82 may move along the axis relative to the plug 60. The first magnet 81 and second magnet 82 are magnetically attracted to each other, and the adjustment base 70 is adjusted and rotated to fit the second magnet 82, the plug 60 and the bottom of the cup body 61, thereby adjusting the separation distance between the second magnet 82 and the plug 60, and the separation distance between the second magnet 82 and the bottom of the cup body 61. The adjustment base 70 is adjusted and rotated to correspondingly fit the plug 60 and the second magnet 82, thereby adjusting and reducing the separation distance between the positions of the second magnet 82 and the first magnet 81. The second magnet and the first magnet are magnetically attracted and located in the connecting sleeve 50 together, and correspondingly the adjustment base can adjust the hinge part 12 to be capable of positioning itself at a required angle within a predetermined angle. If the hinge part needs to be self-positioned at a positioning angle within a predetermined angle, when the hinge part is opened to a position of a desired predetermined angle within the predetermined angle, the hinge part will drive the threaded sleeve in the connecting sleeve 50 in the bushing to rotate, thereby the screw of the fixing bar may slide and move along the axis relative to the threaded sleeve. Meanwhile, the screw of the fixing bar and the first magnet correspondingly cooperate with the leaf of the hinge part to rotate, move and slide downwards, until the leaf of the hinge part is opened to a desired position at a predetermined angle, which is relatively a positioning angle within predetermined angles required by the leaf of the hinge part. Meanwhile, the hinge part has no positioning function. When the hinge part needs to be positioned at a positioning angle within the predetermined angles, the adjustment base in the plug must be adjusted and rotated to correspondingly fit the plug, the second magnet and the bottom of the cup body, thereby adjusting and reducing the separation distance between the positions of the second magnet and the first magnet, such that the second magnet and the first magnet are magnetically attracted and located in the connecting sleeve together, and correspondingly the adjustment base can cooperate and adjust the predetermined positioning angle position required by the leaf of the hinge part within the predetermined angle, such that the leaf of the hinge part is capable of self-positioning at a positioning angle within the required predetermined angle. However, after the leaf 12 of the hinge 10 being opened to the maximum limit point of the predetermined rotating angle, i.e. 180 degree, of the hinge part, the leaf of the hinge part will be close itself and return to a positioning angle position that has been adjusted in place through the adjustment base in the plug, the hinge part needs to be closed after positioning itself, such that the hinge part may be self-closed when the positioning angle of the leaf is out of the positioning angle position within the predetermined angle that has been adjusted in place through the adjustment base in the plug and below a start point. The stored energy coming from magnetic attraction force that magnetically attracts the first magnet 81 and the second magnet 82 together must be greater than the stored energy coming from the elastic force and the stored energy coming from the pre-abutting force of the first spring 91. The first magnet of the hinge is steel that has no stored energy coming from magnetic attraction force or the second magnet is the steel that has no stored energy coming from magnetic attraction force. One of the two magnets is steel that has no stored magnetic force and the other has stored magnetic force. The hinge part may be positioned itself at a single positioning angle within predetermined positioning angles, and closed itself at a single positioning angle and below the starting point of the self-positioning position. A sliding protruding ring 32 is a protruding ring 32. The connecting sleeve 50 is a center sleeve 50.

The fixing bar 30 has the protruding ring 32 fixed to the end provided with the screw 31. The protruding ring 32 is fastened with the annular protruding ring 32 which is fastened with the connecting bar 33, the protruding ring 32 and the annular protruding ring 32 are fastened together to constitute a protruding ring 32. An annular groove 321 is recessed and formed at the outer ring in a circumferential direction of the annular protruding ring 32, a sealing rubber ring 322 is fitted over the annular groove 321 of the annular protruding ring 32, protrudes out of an annular mounting groove 321 to seal and abut in a connecting sleeve 50, and may fit the annular protruding ring 32 to slide and move in the connecting sleeve 50 up and down, so as to generate sealing damping force and resistance force in the connecting sleeve 50 and to have an effect of enhancing the damping force and the resistance force generated by sliding and moving up and down of the annular protruding ring 32 in the connecting sleeve, functions can be increased and enhanced several times, such that the strength of the self-positioning force of the annular protruding ring 32 in the connecting sleeve 50 is enhanced several times, thereby simultaneously cooperating with assisting and enhancing the enhanced release of the energy storage magnetic absorption of the stored energy of the second magnet 82 together with the stored energy of the first magnet 81, such that the second magnet and the first magnet may be strongly positioned together in the connecting sleeve with strong strength through strong magnetic attraction, and such that the strength of the self-positioning force of the leaf 12 of the hinge part 10 at a positioning angle position within a predetermined positioning angle positions is enhanced several times. The enhanced release of the stored bounce strength of the spring 91 is also limited and controlled, the abutting speed and strength of the protruding ring 32 of the fixing bar 30 which is abutted upwards strongly by energy stored in the first spring 91 may be slowed down and buffered, thereby controlling and limiting the self-closing speed of the leaf 12 of hinge part 10, and enhancing the safety performance of the angle-adjustable positioning and self-closing hinge for a highly sealed door and the safety performance of the hinge.

Preferably, the connecting sleeve 50 is provided with a first flange 51, the first flange 51 in the connecting sleeve 50 abuts against a ring groove 403 of the threaded ring 43 in the connecting sleeve 50, such that the first flange 51 can be inserted in the ring groove 403 of the threaded ring 43 in the connecting sleeve 50, thereby the threaded ring 43, the connecting sleeve 50 and the first flange 51 are fixed together in the connecting sleeve 50, the threaded ring 43 may not rotatively, or slidably or movably connected and fixed in the connecting sleeve 50. The threaded ring 43 is provided with a through hole. An inner ring flange 433 of the threaded ring is protrudingly arranged on a front edge of an inner circumference passing through a through hole of the threaded ring 43, such that the inner ring flange of the threaded ring may abut inside the sliding track groove of the protruding ring, the inner ring flange 433 of the threaded ring can correspondingly fit the sliding track groove 322 of the protruding ring 32 of the fixing bar 30, so as to position and limit the axial and spread separation distance of the fixing bar in sliding and moving along an axis up and down relative to the threaded sleeve to be unchanged, thereby correspondingly cooperating with the predetermined positioning angle of the leaf 12 of the hinge part 10, such that the positioning angle of the leaf 12 of the hinge part 10 ranges from 50 degrees to 180 degree. If the 90-degree predetermined positioning angle position within the predetermined positioning angle is scheduled to be set as the start point position for self positioning, the leaf 12 of the hinge part 10 rotates and drives the threaded sleeve in the connecting sleeve 50 of the bushing to rotate when the leaf 12 of the hinge part 10 is opened at a 90-degree positioning angle in the 90-degree predetermined positioning angle. Two or more of six straight-inclination-pitch protruding helical teeth of screw of the fixing bar can slide and move downwards in the axial direction with respect to two or more of six straight-inclination-pitch recessed helical teeth of the threaded sleeve 40, such that six straight-inclination-pitch protruding helical teeth of screw can slide and move downwards in the axial direction relative to six straight-inclination-pitch recessed helical teeth of the threaded sleeve. Meanwhile, the screw of the fixing bar and the first magnet correspondingly cooperates with the leaf 12 of the hinge part 10 to slide and move downwards, until the leaf 12 of the hinge part 10 is opened to a desired 90-degree predetermined angle position, i.e. the 90-degree positioning angle position within the predetermined angle required by the leaf 12 of the hinge part 10. Meanwhile, the leaf 12 of the hinge part 10 has no positioning function. When the hinge leaf needs to be positioned at a 90-degree positioning angle within the predetermined angle, the adjustment base in the plug 60 must be adjusted and rotated to correspondingly fit the plug 60, the second magnet and the bottom of the cup body 61, thereby adjusting and reducing the separation distance between the positions of the second magnet and the first magnet, such that the second magnet and the first magnet are magnetically attracted and located in the connecting sleeve together, and correspondingly the adjustment base can cooperate and adjust the 90-degree predetermined positioning angle position required by the leaf 12 of the hinge part 10 within the predetermined angle, such that the leaf 12 of the hinge part 10 is capable of self-positioning at a 90-degree positioning angle within the required predetermined angle. However, after the leaf 12 of the hinge 10 being opened the maximum limit point of the predetermined rotating angle, i.e. 180 degree, and released, the first spring 91 is compressed (the first spring 91 has an energy storage elastic state) under strong high pressure from top to bottom applied by the annular protruding ring 32 of the fixing bar 30 to change the energy storage state of the first spring 91, thereby the energy storage elastic force is released, thereby one end of the first spring 91 with energy storage elastic force strongly abuts against the annular protruding ring 32, and the other end of the first spring 91 with energy storage elastic force strongly abuts against the front circumferential flat of the cup body 61 and the pad 85, such that the leaf 12 of the hinge part 10 will be self-closed and back to the 90-degree positioning angle position within the required predetermined angle that has been adjusted in place through the adjustment base in the fixing base, the leaf 12 of the hinge part 10 needs to be closed after self positioning, such that the leaf 12 of the hinges leaf 10 may be self-closed when the positioning angle of the leaf 12 of the hinge part 10 is out of the 90-degree positioning angle position within the predetermined angle that has been adjusted in place through the adjustment base in the fixing base and below a start point. The threaded ring 43 is arranged below the threaded sleeve, and the screw 31 is sleeved by and passes through the through hole of the threaded ring and then is threaded to the threaded sleeve 40. The fixing bar has the protruding ring fixed to the end provided with the screw. The protruding ring is fastened with an annular protruding ring which is fastened with a connecting bar, the protruding ring 32 and the annular protruding ring 32 are fastened to constitute a protruding ring 32. A protruding ring sliding track groove 332 is recessedly arranged on a side of an outer circumference of the protruding ring 32 of the fixing bar 30, and an inner ring flange 433 of the threaded ring is protrudingly arranged on a front edge of an inner circumference, such that the inner ring flange of the threaded ring may abut inside the sliding track groove of the protruding ring, and the inner ring flange 433 of the threaded ring may correspondingly fit the sliding track groove 332 of the protruding ring, so as to position and limit the axial and circumferential separation distance of the fixing bar in sliding and moving along an axis up and down relative to the threaded sleeve to be unchanged, thereby correspondingly fit the predetermined positioning angle of the leaf 12 of the hinge part 10. The threaded ring 43 fits the sliding track groove 332 of the protruding ring, so as to position and limit the axial and spread separation distance of the fixing bar in sliding and moving along an axis up and down relative to the threaded sleeve to be unchanged, so as to cooperate with the leaf of hinge part, such that the leaf of the hinge part may be freely positioned at a positioning angle, correspondingly that the leaf 12 of the hinge part 10 can be positioned at a needed positioning angle within the predetermined angle. A third flange 53 is provided in the connecting sleeve 50. The third flange 53 abuts in the annular groove 530 of the first bearing in the connecting sleeve 50, such that the third flange 53 in the connecting sleeve 50 may be inserted in the annular groove 530 of the first bearing, thereby the first bearing 44 and the third flange 53 may be connected and fixed in the connecting sleeve without moving up and down relative to each other (by the third flange 53 provided in the connecting sleeve, the third flange 53 in the connecting sleeve 50 may be inlaid in the annular groove 530 of the first bearing, and axially restrain displacement of the first bearing 44). The threaded sleeve 40 has a thin rod 42 that is sleeved through the through hole of the first bearing 44. A second bearing 34 is also provided among the connecting rod 33 of the fixing bar 30, the first spring and the connecting sleeve. The second bearing 34 auxiliarly smooth rotation of the leaf 12 of the hinges leaf 10 between opening and closing, and the first spring 91 is fitted over the connecting rod 33 and abuts against and arranged between the second bearing 34 and the pad 85 on the front end of the cup body 61. A second flange 52 is disposed in the connecting sleeve 50. The second flange 52 in the connecting sleeve 50 abuts against inner of the annular groove 520 of the plug 60, such that the second flange 52 can be inlaid in the annular groove 520 of the plug 60. The plug 60 and the second flange 52 may be connected and fixed together in the connecting sleeve without moving up and down relative to each other, and the outer portion of the plug 60 protruding from the connecting sleeve is fixed within the bushing 21. The bottom of the first magnet is provided with a protruding ring edge 811, and the first magnet is provided with the pad 85 which abuts against the front end surface of the cup body 61, and the first spring abuts against and arranged between the pad 85 and the second bearing 34. The inner ring flange 433 of the threaded ring is fitted over and slidingly connected to the sliding sleeve 333, such that the inner ring flange 433 of the threaded ring which is fitted over and slidingly connected with the sliding sleeve 333 may abut against the inner of the sliding track groove 332 of the protruding ring, the inner ring flange 433 of the threaded ring which is fitted over and slidingly connected with the sliding sleeve 333 correspondingly fits the sliding track groove 332 of the protruding ring 32 of the fixing bar 30, thereby aiding to enhance smoothing of up and down sliding and moving of the fixing bar along the axis with respect to the threaded sleeve, and smoothing the opening and closing of the leaf of the hinges leaf.

The screw ring 43 is located under the threaded sleeve, and the screw 31 passes through the screw ring 43 and then is threaded to the threaded sleeve 40, such that the threaded ring 43 may restrain the rotation, sliding and movement of the screw 31 relative to the threaded sleeve 40, producing spacing coefficient, so as to control and limit the axial and spread separation distance of the fixing bar 30 in sliding and moving along an axis up and down relative to the threaded sleeve to be unchanged, so as to cooperate with the leaf of hinge part, such that the leaf of the hinge part may be freely predetermined at a positioning angle, correspondingly that the leaf of the hinge part can be positioned itself at a positioning angle within the predetermined angle, i.e. at a positioning angle in a required predetermined angle.

A first screw 83, a second screw 84 and a fixed screw 98 are provided. The first screw 83 and the second screw 84 both have a smooth section and a threaded section 831, 841 at the end, the smooth section of the first screw 83 passes through the through hole of the inner ring of the first magnet 81, and the threaded section 831 is screwed into the through hole of the screw of the connecting bar 33 of the fixing bar 30, such that a screw head 832 of the first screw 83 is supported on a step 801 of the through hole of the inner ring of the first magnet 81. The first magnet 81 and the connecting bar 33 are fixed together, such that the first magnet 81 may slide and move together with the fixing bar 30, and the first magnet may also be restricted from detaching from the first screw, and cooperate with the adjustment base 70 of the plug 60, such that the adjustment base 70 may be adjusted and rotated to cooperate with the plug 60, the second magnet 82 and the bottom of the cup body 61, thereby adjusting and reducing the separation distance between the positions of the second magnet 82 and the first magnet 81, such that the adjustment base 70 correspondingly cooperates and adjusts the hinge part to be capable of self-positioning at a needed positioning angle within the predetermined positioning angle. The smooth section of the second screw 84 passes through the through hole of the inner ring of the second magnet 82, and the threaded section 841 is screwed into the through hole of the screw at the end of the adjustment base 70, such that the screw head 842 of the second screw 84 is supported on the step 821 of the through hole of the inner ring of the second magnet 82. The second magnet 82 and the first magnet 81 are connected with the adjustment base 70, and the second magnet 82 may also be restricted from detaching from the second screw 84, and the second magnet 82 cooperates with the plug 60, the adjustment base 70 and the bottom of the cup body 61, such that the adjustment base 70 may be adjusted and rotated to cooperate with the plug 60, the second magnet 82 and the bottom of the cup body 61, thereby adjusting and reducing the separation distance between the positions of the second magnet 82 and the first magnet 81, thereby the second magnet and the first magnet are magnetically attracted together and located in the connecting sleeve, and the adjustment seat correspondingly cooperates and adjusts the predetermined positioning angle of the leaf of the hinge part, such that the leaf of the hinge part can be self-positioned at a needed positioning angle within the predetermined positioning angle. The fixing screw 98 passes through the through hole of the screw of the bushing 21 and threaded to and passes through the plug 60, and then is locked and screwed in the adjustment base 70, meanwhile, the fixing screw 98 is not firstly locked and screwed into the adjustment base 70 together with the bushing 21 and the plug 60. After that the adjustment base 70 is adjusted and rotated to correspondingly cooperate with the plug 70, the second magnet 82 and the bottom of the cup body 61, thereby adjusting and reducing the separation distance between the positions of the second magnet 82 and the first magnet 81, such that the second magnet and the first magnet are magnetically attracted together and located in the connecting sleeve, and correspondingly the adjustment base can cooperate and adjust the predetermined positioning angle of the leaf of the hinge part, such that after the leaf of the hinge part self-positioned at a positioning angle within required predetermined positioning angle in the predetermined positioning angle, the adjustment base is again activated by the standby fixing screw 98 to prevent the adjustment base from loosening. The fixing ring 98 passes through the bushing 11 and is screwed and passes through the rotating ring 41, and then the fixing ring 98 is locked and screwed into the thin bar 42 of the threaded sleeve, such that the busing 11 and the rotating ring 41 and the thin bar 42 are fixedly connected together, thereby the leaf 12 of the hinge part 10 may drive the threaded sleeve 40 to rotate, such that the screw 31 may slide and move relative to the threaded sleeve 40 along the axis.

In a specific structure, the adjustment base 70 is a third screw, the third screw is threaded through the plug, and an exposed portion of the third screw abuts against the bottom of the cup body. The third screw may be adjusted and rotated to fit the plug, the second magnet, and the bottom of the cup body, thereby adjusting and reducing the separation distance between the positions of the second magnet 82 and the first magnet 81, such that the second magnet and the first magnet are magnetically attracted together and located in the connecting sleeve, and the adjustment base can correspondingly cooperate and adjust the leaf 12 of the hinge part 10 to be capable of self-positioning at a needed positioning angle within the predetermined positioning angle. Preferably, the threaded section 841 of the second screw 84 is screwed into the end face of the adjusting base 70 of the plug 60. The second spring and the second magnet are completely located in cup body to which the second magnet fits and slidingly connected, and the lower portion of the first magnet fits and is slidingly connected to the cup body. The screw is controlled by the threaded sleeve and the threaded ring, the teeth of the screw matches the teeth of the threaded sleeve, such that the inner ring flange 433 of the threaded ring fits the sliding track groove 332 of the protruding ring 32 of the fixing bar 30, thereby achieving up-down sliding and moving at predetermined consistent angle and distance therebetween, so as to control and limit the axial and spread separation distance of the fixing bar 30 in sliding and moving along an axis up and down relative to the threaded sleeve to be unchanged, and cooperate with the leaf of the hinge part to make the leaf of the hinge part freely predetermine positioning angle. The first spring 91 and the second spring 92 may urge the leaf 12 of the hinge part 10 to be loosened after the leaf 12 of the hinge part 10 is opened to 125 degrees exceeding the self-positioned angle position of the 90-degree in predetermined positioning angle within the ranges of 50-180 degrees, at which the leaf 12 of the hinge part 10 is opened. Meanwhile, the first spring 91 is in an energy storage elastic state that the first spring 91 is compressed under strong high pressure from top to bottom applied by an annular protruding ring 32 of the fixing bar 30, such that the energy storage state of the first spring 91 is changed, thereby the energy storage elastic force is released. One end of the first spring 91 with energy storage elastic force strongly abuts against the ring protruding ring 32, and the other end of the first spring 91 with energy storage elastic force strongly abuts against the front circumferential flat of the cup body 61 and the supporting pad 85. The second spring 92 is in an energy storage elastic state that the second spring 92 is compressed under strong high pressure from top to bottom applied by the annular protruding ring 32, fitting the first magnet 81 and the second magnet 82 of the fixing bar 30, the energy storage state of the second spring 92 can be changed, thereby the energy storage elastic force of the second spring 92 is released. One end of the second spring 92 with energy storage elastic force strongly abuts against second magnet 82, and the other end of the second spring 92 with energy storage elastic force strongly abuts against the bottom of the cup body 61, such that the first spring 91 and the second spring 92 enable the leaf 12 of the hinge part 10 to be closed back, and the first spring 91 and the second spring 92 enable the leaf 12 of the hinges leaf 10 to be self-closed and back to the 90-degree positioning angle within the predetermined positioning angle.

Embodiment 2

The difference between Embodiment 1 and Embodiment 2 is that: as shown in FIG. 29 to FIG. 33, the protruding seat is protrudingly arranged at a lower part of the fixing plate of the fixing base, the protruding seat occupies approximately half of the fixing plate, and the bushing of the hinge part is arranged on the protruding seat. The hinge part 10 is provided with a bushing 11 and the leaf 12 fastened outside the bushing 11, the fixing base 20 is provided with a fixing plate 25, a vertical bottom plate 22, and a protruding seat 23 fastened to the vertical bottom plate 22. A bushing 21 is recessed in the end face of the vertical base plate 22 of the protruding seat 23. A connecting sleeve 50 is connected to the bushing 11 and a bushing 21 of the protruding seat 23. The busing 11 and the bushing 21 are arranged abreast, such that the leaf 12 of the hinge part 10 may rotate relative to the bushing 21 of the protruding seat 23 and the fixing seat 20, and the hinges may constitute the structure of an angle-adjustable positioning and self-closing hinge for a highly sealed flat door or convex door. The threaded sleeve 40 may be rotatably and non-slidably connected to a connecting sleeve 50 within the busing 11, and the rotary ring 41 within the busing 11 of the hinge part 10 is fixedly connected to part of the thin rod 42 protruding out of the connecting sleeve 50 of the threaded sleeve 40, and the fixed connection is provided with a rotary ring 41. The thin rod 42 is protrudingly arranged on the upper part of the threaded sleeve 40. The thin rod 42 of the threaded sleeve 40 may rotatably pass through the rotary ring 41. The rotary ring 41 fits at the upper part of the busing 11, and a fixing screw 98 is provided and screwed into the busing 11, is locked and passes through the rotary ring 41 and further locked into and fixedly connected with the thin rod, such that the busing 11 and the rotary ring 41 are fixed together with the thin rod, as to control the axial and circumferential separation distance of the fixing bar 30 in sliding and moving along an axis up and down relative to the threaded sleeve. The rotary ring 41 and the right busing 11 also limit and control the axial movement of the threaded sleeve 40, which correspondingly makes the leaf of the hinge part to predetermine a positioning angle freely. The connecting sleeve 50 is provided with a second flange 52, and a ring groove 520 in the outer ring in a circumferential direction of the plug cooperates with the second flange 52 and the connecting sleeve 50, such that the plug 60, the second flange 52, and the connecting sleeve 50 may be fixedly connected in the connecting sleeve 50. As for the part of the plug 60 protruding out of the connecting sleeve 50, the fixing screw 98 is screwed through the through hole of the screw of the bushing 21, and is locked and fixedly connected to the plug 60, and then is locked and fixedly connected to the adjustment base 70, meanwhile, the fixing screw 98 is not firstly locked and fixedly connected to the adjustment base 70 together with the bushing 21 and the plug 60; after that the adjustment base 70 is adjusted and rotated to correspondingly fit the plug 60, the second magnet 82 and the bottom of the cup body 61, thereby adjusting and reducing the separation distance between the positions of the second magnet 82 and the first magnet 81, such that the second magnet and the first magnet are magnetically attracted together and located in the connecting sleeve, and correspondingly the adjustment base can adjust the leaf of the hinge part to be capable of self-positioning at a positioning angle position within required predetermined angle in the predetermined angle, the standby fixing screw 98 is again activated to lock and fixedly connect to the adjustment base 70, to prevent the adjustment base 70 from loosening. The threaded sleeve and the plug are spaced apart, a fixing bar 30, a threaded ring 43, a first magnet 81, a second magnet 82, a cup body 61, a pad 85, a first spring 91 and a second spring 92 are provided between the threaded sleeve and the plug in the connecting sleeve. The fixing bar 30 has a screw 31. The first magnet 81 and second magnet 82 are magnetically attracted to each other. The sliding track protruding ring 32 is a protruding ring 32. The connecting sleeve 50 is a center sleeve 50.

Embodiment 3

Figure 34:
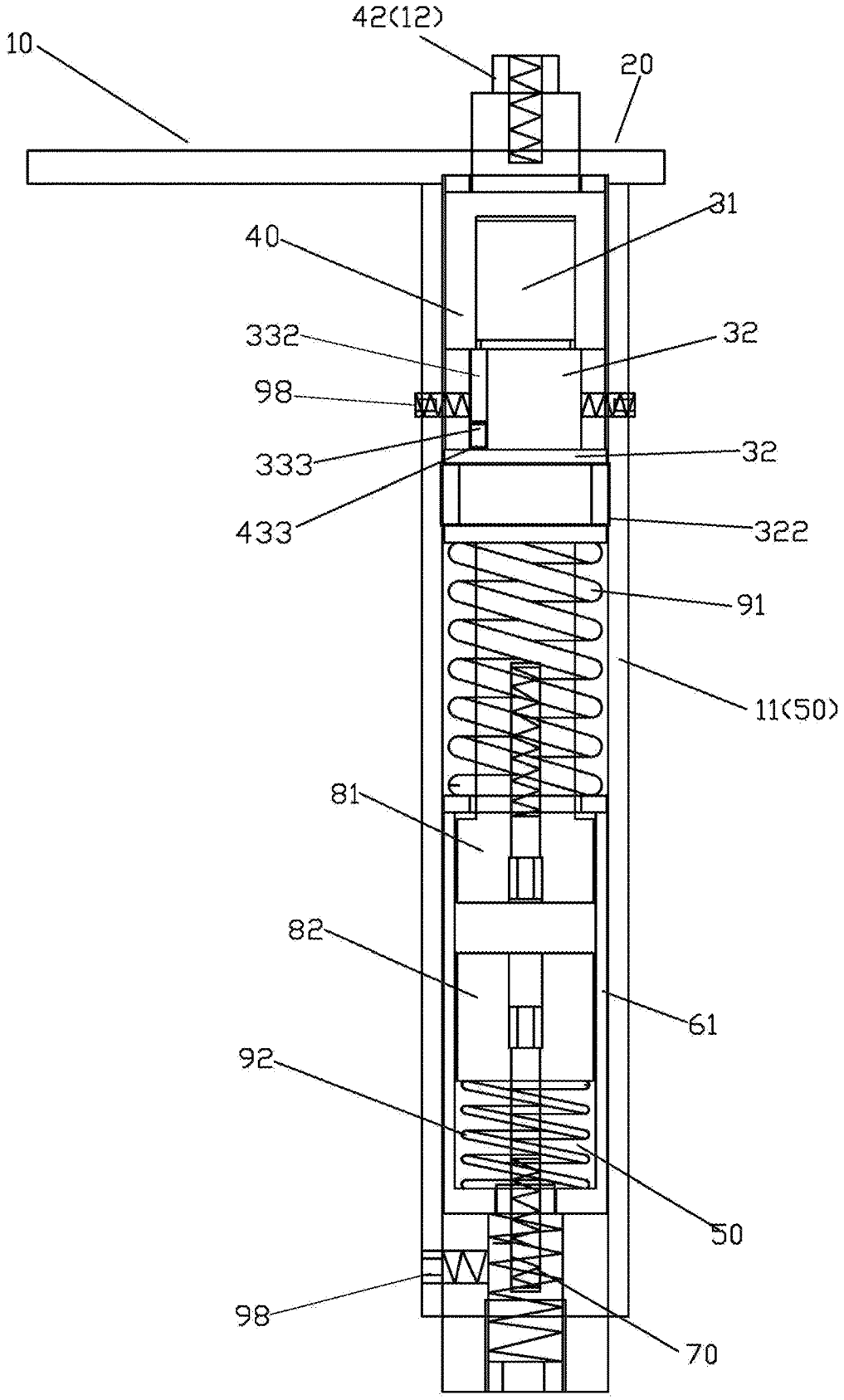
FIG. 34 illustrates a schematic view of a hinge according to Embodiment 3.

The difference between Embodiment 1 and Embodiment 3 is that: as shown in FIG. 34, an angle-adjustable positioning and self-closing hinge for a highly sealed door includes a hinge part, a fixing base, a fixing bar and a threaded sleeve. The threaded sleeve 40 has a thin bar 42 which is rotatable relative to the fixing bar 30 and fixing base 20; the thin bar 42 constitutes the leaf 12, thus the thin bar 42 is fastened on a door sheet of the high-sealing door through a fixing screw 98. A bushing 11 constitutes a connecting sleeve 50, the hinge part is rotatable relative to the fixing base, and the fixing bar has a screw. The angle-adjustable positioning and self-closing hinge for a highly sealed door also includes a plug and an adjustment base, the threaded sleeve may be rotatably and immovably connected inside one end of the bushing; a threaded ring 43 is fastened in a through hole of a screw of the bushing 11 through the fixing screw 98, and the threaded ring 43 may support the threaded sleeve 40 so as to prevent the threaded sleeve 40 from falling down, and the plug is fastened inside the other end of the bushing. The threaded sleeve and the plug are spaced apart. The fixing bar, the threaded ring 43, a first magnet, a second magnet, a cup body, a pad, a first spring and a second spring are provided between the threaded sleeve and plug in the bushings, a screw of the fixing bar is screwed to the threaded sleeve, the first spring abuts between the fixing bar and the front outer edge and the pad of the cup body, and the first magnet is slidable and movable together with the fixing bar; one end of the second spring may abut the bottom of the cup body and the plug, and the other end of the second spring abuts the second magnet at, the second magnet may move relative to the plug, the first magnet and second magnet are magnetically attracted to each other, and the adjustment base is adjusted and rotated to correspondingly fit the second magnet, the plug and the bottom of the cup body 61, thereby adjusting and reducing the separation distance between the positions of the second magnet and the plug; the adjustment base is adjusted and rotated to correspondingly fit the second magnet, the plug and the bottom of the cup body 61, thereby adjusting and reducing the separation distance between the positions of the second magnet and the first magnet, such that the second magnet and the first magnet may be magnetically attracted together and located in the connecting sleeve, and such that the adjustment base may correspondingly fit the leaf of the hinge part to self-position in the required positioning angle position of the predetermined positioning angle.

The angle-adjustable positioning and self-closing hinge for a highly sealed door further includes a cup body 61 which may be relatively movably arranged in the bushing 50, the second spring 92 may abut between the bottom of the cup body 61 and the second magnet 82, and the adjustment base 70 connects the bottom of the cup body 61 and the plug 60 for the adjustment of the separation distance between the bottom and the plug 60, thereby adjusting and reducing the separation distance between the plug and the second magnet; the adjustment base cooperates with the second magnet and the plug, thereby adjusting and reducing the separation distance between the second magnet and the first magnet, such that the adjustment base may correspondingly cooperates with the leaf 12 of the hinge part 10 to self-position in the required positioning angle of the predetermined positioning angle.

The thin bar 42 (the thin bar 42 herein is the leaf 12 of the hinge part 10) is fastened on the door sheet of the high-sealing door through the fixing screw 98, so as to control the axial and circumferential separation distance of the fixing bar 30 in sliding and moving along an axis up and down relative to the threaded sleeve, relative rotation can be achieved through the screwing between the screw 31 inside the threaded sleeve 11 of the hinge part 10 and the threaded sleeve 40, the fixing screw 98 is screwed through the connection sleeve 50 and screwed, locked and fixed to the threaded ring 43, such that the screw ring 43 may be non-slidably fastened inside the connection sleeve 50. The screw ring 43 is located under the threaded sleeve and the screw rod 31 is inserted through the screw ring 43 and then screwed to the threaded sleeve 40. Moreover, the inner ring flange 433 of the threaded ring is protrudingly arranged on a front edge of an inner circumference passing through a through hole of the threaded ring 43. The fixing bar 30 has a protruding ring 32, of which a sliding track groove 332 is concavely arranged, such that the inner ring flange of the threaded ring may abut inside the sliding track groove of the protruding ring, and such that the inner ring flange 433 of the threaded ring may correspondingly fit the sliding track groove 332 of the protruding ring 32 of the fixing bar 30, so as to control and limit the axial and spread separation distance of the fixing bar 30 in sliding and moving along an axis up and down relative to the threaded sleeve, such that the leaf of the hinge part opens at 90 degrees to drive the threaded sleeve inside the connection sleeve to rotate, such that two or more of six straight-inclination-pitch protruding helical teeth of the screw of the fixing bar can slide and move downwards in the axial direction with respect to two or more of six straight-inclination-pitch recessed helical teeth of the threaded sleeve 40, meanwhile the screw of the fixing bar in the connecting sleeve can slide and move upwards and downwards along an axis relative to the threaded sleeve, and the screw of the fixing bar and the first magnet can rotate and slide downwards. Meanwhile when the hinge part opens at 90-degree positioning angle, the leaf of the hinge lead has no function, and when the leaf of the hinge part requires to be positioned at a 90-degree predetermined angle, the adjustment base inside the plug must be adjusted and rotated to correspondingly cooperate with the plug, the second magnet and the bottom of the cup body 61, thereby adjusting and reducing the separation distance between the positions of the second magnet and the first magnet, such that the first magnet and second magnet are magnetically attracted to each other and positioned inside the connecting sleeve, such that the adjustment base may correspondingly adjust the predetermined angle of the leaf of the hinge part, such that the leaf of the hinge part may self-position at a desired 90-degree predetermined angle position. However, the leaf of the hinge part may achieve self-closing when the positioning angle of the leaf of the hinge part is below the 90-degree positioning angle position of the predetermined angle.

Embodiment 4

Figure 35:
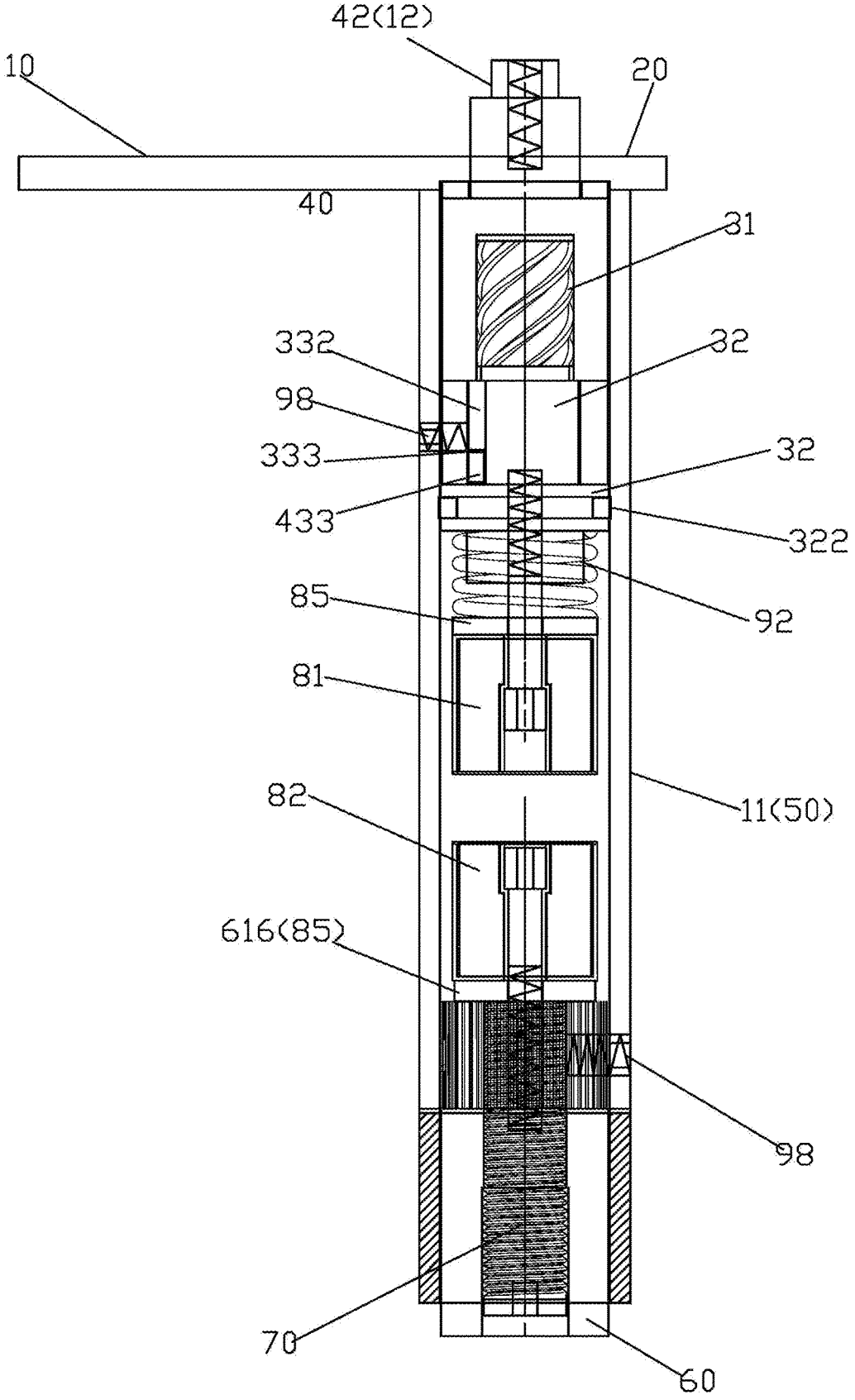
FIG. 35 illustrates a schematic view of a hinge according to Embodiment 4.
Figure 36:
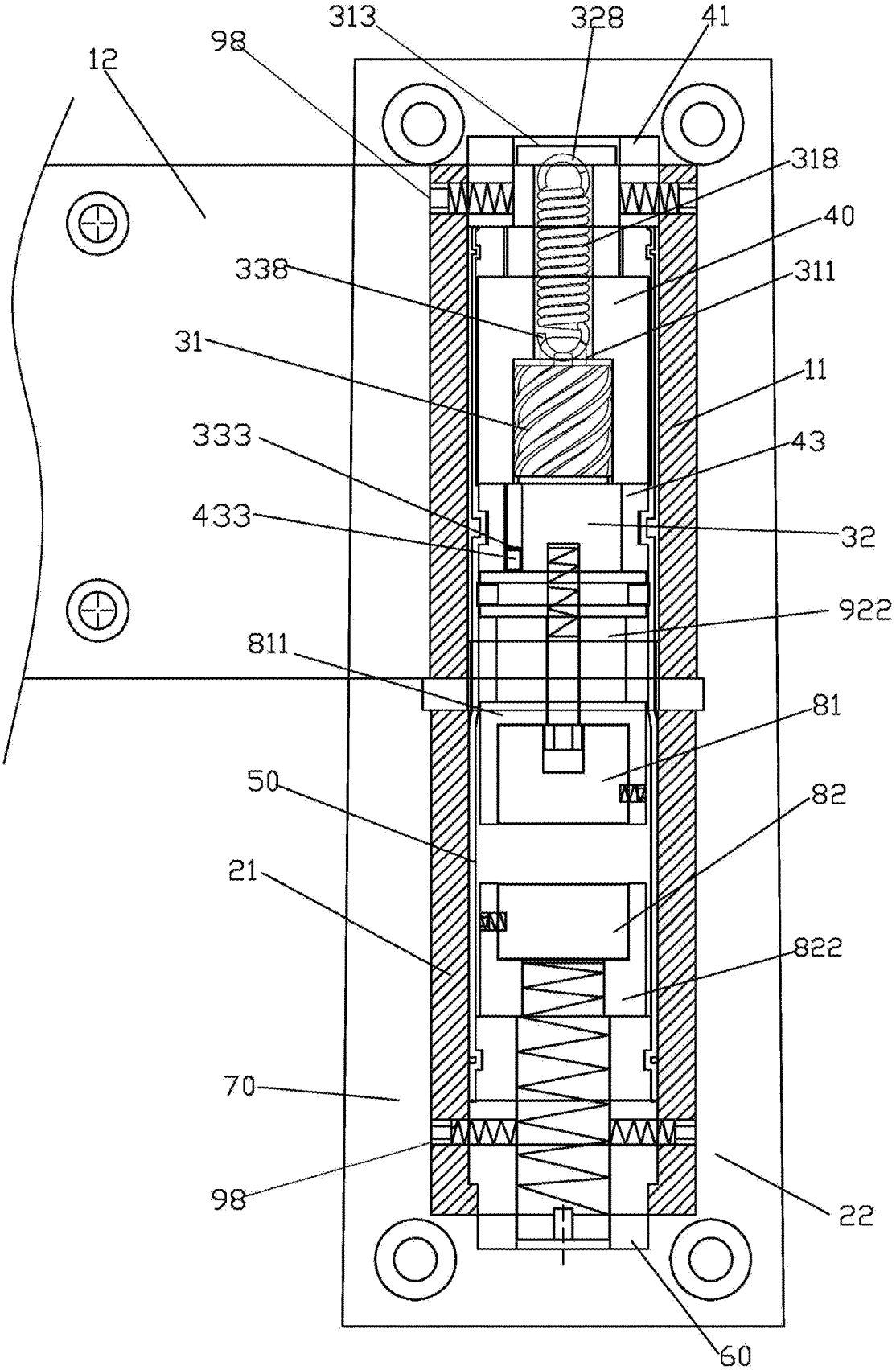
FIG. 36 illustrates a schematic view of a hinge according to Embodiment 5.
Figure 37:
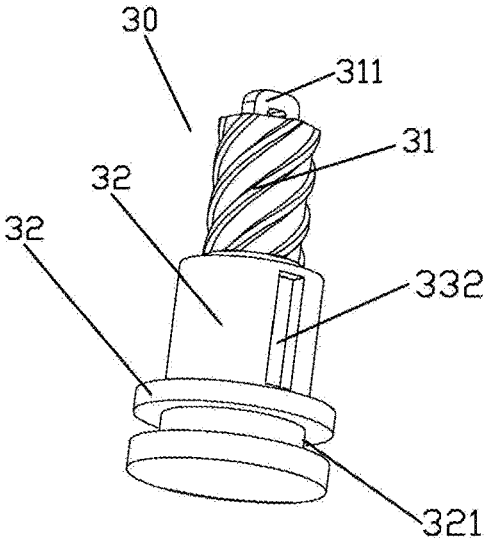
FIG. 37 illustrates a perspective view of a screw ring according to Embodiment 5.
Figure 38:
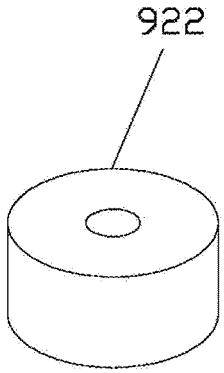
FIG. 38 illustrates a perspective view of a rubber column according to Embodiment 5.
Figure 40:
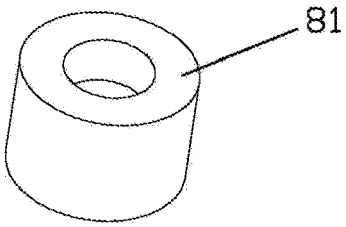
FIG. 40 illustrates a perspective view of a first magnet according to Embodiment 5.
Figure 39:
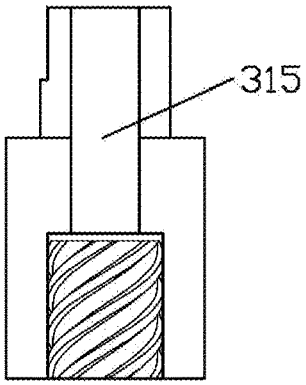
FIG. 39 illustrates a schematic view of a through hole for a spring of a threaded sleeve according to Embodiment 5.
Figure 41:
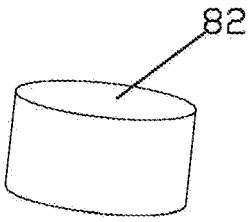
FIG. 41 illustrates a perspective view of a second magnet according to Embodiment 5.
Figure 42:
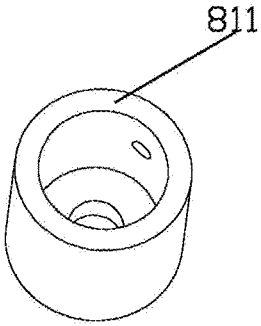
FIG. 42 illustrates a perspective view of a cap of the first magnet according to Embodiment 5.
Figure 43:
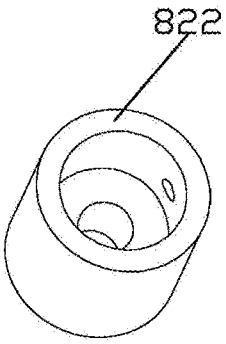
FIG. 43 illustrates a perspective view of the cap of the second magnet according to Embodiment 5.

The difference between Embodiment 1 and Embodiment 4 is that: as shown in FIG. 35, an angle-adjustable positioning and self-closing hinge for a highly sealed door includes a hinge part, a fixing base, a fixing bar and a threaded sleeve. The threaded sleeve 40 has a thin bar 42 which is rotatable relative to the fixing bar 30 and fixing base 20; the thin bar 42 constitutes the leaf 12, thus the thin bar 42 is fastened on the door sheet of the high-sealing door through the fixing screw 98. A bushing 11 constitutes a connecting sleeve 50, the hinge part is rotatable relative to the fixing base, and the fixing bar has a screw. The angle-adjustable positioning and self-closing hinge for a highly sealed door also includes a plug and an adjustment base. The threaded sleeve may be rotatably and immovably connected inside one end of the bushing; the threaded ring 43 is fastened in the bushing 11 through the fixing screw 98, and the threaded ring 43 may support the threaded sleeve 40 so as to prevent the threaded sleeve 40 from falling down, and the plug is fastened inside the other end of the bushing; the threaded sleeve and the plug are spaced apart; a fixing bar, a threaded ring 43, a first magnet, a second magnet, a cup body, a pad, a first spring and a second spring 92 are provided between the threaded sleeve and the plug in the bushings. A screw of the fixing bar is screwed to the threaded sleeve, the first spring abuts among the fixing bar, the front end face of the cup body and the pad, and the first magnet is slidable and movable along with the fixing bar. The second spring may abut relative to the bottom of the cup body and the plug head at one end and abut the second magnet at the other end, the second magnet may move relative to the plug. The first magnet and second magnet are magnetically attracted to each other, the adjustment base is adjusted and rotated to correspondingly cooperate with the second magnet and the bottom of the cup body 61 and plug, thereby adjusting and reducing the separation distance between the positions of the second magnet and the plug, such that the second magnet and the first magnet may be magnetically attracted to each other and positioned together in the connecting sleeve, and such that the adjustment base may correspondingly adjust the leaf of the hinge part to self-position in the required positioning angle position of the predetermined positioning angle.

In a specific structure, the fixing bar 30 has a fixedly connected screw 31, and the screw 31 also has a fixedly connected protruding ring 32 (moreover, the protruding ring 32 and the annular protruding ring 32 are fastened to constitute a protruding ring 32). A pad 616 for auxiliary-adjusting positioning angle of the leaf constitutes the bottom of the cup body 61 (the pad 616 for auxiliary-adjusting the positioning angle of the leaf is the bottom of the cup 61). The fixing bar 30 has a sliding track protruding ring 32, of which a mounting groove 811 is concavely arranged on a side of an outer ring; an air-leak-proof sealing ring 824 is provided in the mounting groove 811, protrudes out of the mounting groove 811 to seal and abut in the bushing 11 (connecting sleeve 50), so as to help and stabilize the axial and circumferential separation distance of the screw in the bushing 11 in up and down sliding and moving along an axis relative to the threaded sleeve. The adjustment base cooperates with the second magnet, the plug and the pad 616 for auxiliary-adjusting the positioning angle of the leaf, so as to adjust and reduce the separation distance of the second magnet and the first magnet, such that the second magnet and the first magnet are positioned together in the connection sleeve under the action of magnetic attraction, and such that the adjustment base may correspondingly cooperate with and adjust the predetermined positioning angle of the hinge part, such that the leaf of the hinge may be self-positioned at a positioning angle position within the predetermined positioning angle; and when a positioning angle within the predetermined positioning angle is below the starting point of the self-positioned position, such that the leaf of the hinge part cannot self-position the boundary point. That is, the leaf of the hinge part may self-position when rotating to a positioning angle of predetermined angle, and may be closed itself when the positioning angle within the predetermined angle is below the starting point of the self-positioned position. A sliding and rotating sleeve 333 is sleeved over the fixed sliding bar 339 such that an inner ring flange 433 of the threaded ring fitted over and slidingly connected to the sliding and rotating sleeve 333 may abut inside the sliding track groove 332 of the protruding ring, and such that the inner ring flange 433 of the threaded ring fitted over and slidingly connected to the sliding and rotating sleeve 333 may correspondingly fit the protruding ring sliding track of the protruding ring 32 of the fixing bar 30 to pass through a groove through hole 332, and so as to assist in reinforcing the smooth movement of the fixing bar in sliding and moving along an axis up and down relative to the threaded sleeve, and the leaf of the hinge part may be more smoothly opened and self-closed. The protruding ring 32 is an annular protruding ring 32, and the sliding protruding ring 32 and the annular protruding ring 32 are fastened to constitute the protruding ring 32. The second spring is located among the annular protruding ring 32 of the fixing bar 30, a spring pad 93 and the first magnet 81. The second spring 92 may enable the leaf 12 of the hinge part 10 to open to an angle of 125 degrees when the leaf 12 of the hinge part 10 is opened, such that the leaf 12 of the hinge part 10 is opened at a self-positioning angle exceeding a 90-degree predetermined angle in a range of the predetermined positioning angle from 50 degrees to 180 degrees, and meanwhile the second spring 92 is in an energy storage elastic state that the second spring is compressed under strong high pressure from top to bottom applied by cooperation of the annular protruding ring 32 of the fixing bar 30 and the first magnet 81, such that the energy storage elastic state of the second spring 92 is changed, and the energy storage elastic fore is released, such that the second spring 92 may strongly support and hold the annular protruding ring 32 at one end with energy storage elastic force and abut the pad 85 and the first magnet 81 at the other end with energy storage elastic force, such that the second spring 92 may assist the leaf 12 of the hinge part 10 to close back, thereby resetting the leaf 12 of the hinge part 10 to a 90-degree predetermined angular position to position itself. The second spring 92 may enable the leaf 12 of the hinge part 10 to open at an angle of 125 degrees after the opened leaf 12 of the hinge part 10 is released, and the leaf 12 of the hinge part 10 is opened at a self-position angle exceeding the 90-degree predetermined angle in a range of the predetermined positioning angle from 50 degrees to 180 degrees, and meanwhile the second spring 92 is presented in an energy storage elastic state that the second spring is compressed under strong high pressure from top to bottom applied by cooperation of the annular protruding ring 32 of the fixing bar 30 and the first magnet 81, such that the energy storage elastic state of the second spring 92 is changed, and the energy storage elastic force is released, such that the second spring may strongly support and hold the annular protruding ring 32 at one end with energy storage elastic force and abut the pad 85 and the first magnet 81 at the other end with energy storage elastic force, such that the second spring 92 may make the leaf 12 of the hinge part 10 close back, thereby resetting the leaf 12 of the hinge part 10 to position itself at a predetermined angular position of 90 degrees.

Embodiment 5

The difference between Embodiment 1 and Embodiment 5 is that: as shown in FIG. 36 to FIG. 43, in a specific structure, an end of the screw of the fixing bar is also fixedly connected with a sliding protruding ring 32 which is also fixedly connected with a protruding ring 32, the protruding ring 32 also has a fixedly connected connecting bar 33. The screw 31 is fixedly connected with a screw ring 311. A hook bar 313 fits the through hole of the rotary ring 41 in dimension, and the device is placed flatly on the upper end of the thin rod 42, the threaded sleeve 40 and the thin rod 42 of the threaded sleeve 40 have a threaded sleeve tension spring through hole 315 in which a tension spring 318 is arranged. The tension spring 318 is fixedly connected with a front hook 328 and a rear hook 338 at two ends, the front hook 328 of the tension spring 318 hooks on the hook bar 313, and the rear hook 338 of the tension spring 318 hooks on the screw ring hook 311, such that the tension spring 318 may control the distance of the up and down sliding and moving of the screw 31 of the fixing bar along the axis relative to the threaded sleeve unchanged. The second spring 92 is located among the protruding ring 32 of the fixing bar 30, the spring pad 93 and the first magnet 81. The inner ring flange 433 of the threaded ring is fitted over and slidingly connected to the sliding sleeve 333, such that the inner ring flange 433 of the threaded ring which is fitted over and slidingly connected to the sliding sleeve 333 may abut against inner of the protruding ring sliding track groove 332 and may cooperate with the sliding track groove 332 of the protruding ring 32 of the fixing bar 30, thereby assisting and enhancing smooth up and down sliding and moving of the fixing bar along the axis with respect to the threaded sleeve, and smoothing the opening and closing of the leaf of the hinges leaf. An end provided with a screw of the fixing bar is provided with a fixedly connected protruding ring 32, the protruding ring 32 is fastened with an annular protruding ring 32 which is fastened with a connecting bar 33, such that the protruding ring 32 and the annular protruding ring 32 are fastened to constitute a protruding ring 32. An annular groove is concavely formed at the outer ring in a circumferential direction of the annular protruding ring 32, a sealing rubber ring 322 is sleeved around the annular groove 321 of the annular protruding ring 32, protrudes out of the annular groove 321 to seal and abut in a connecting sleeve 50, thereby assisting the axial and circumferential distance of the screw in the connecting sleeve 50 in sliding and moving up and down along the axis with respect to the threaded sleeve within without shaking. The airtight sealing rubber ring also has a function of assisting, supplementing and reinforcing the energy storage of the second magnet and releasing the energy storage magnetic force of the first magnet, such that the second magnet and the first magnet may be strongly magnetically attracted and positioned in the connecting sleeve in a strong manner, thereby assisting, supplementing and reinforcing the self-positioning force of the leaf of the hinge part at a predetermined positioning angle within the predetermined positioning angle. A pad 616 for auxiliary-adjusting positioning angle of the leaf constitutes the cup bottom of the cup body 61, the bottom of the cup body may be a pad 85. The fixing screw 98 passes through a side circumferential through hole of a cap 811 of the first magnet and then is screwed into the first magnet 81, such that the cap 811 of the first magnet and the first magnet 81 are fixed together. The cap of the first magnet 811 is made of epoxy or any kind of rubber, such that the cap of the first magnet 811 and the first magnet 8 lare fixed together. The first screw 83 passes through the through hole of the cap 811 of the first magnet, passes through a rubber column 922 and then is locked and screwed into the annular protruding ring 32, such that the cap 811 of the first magnet, the first magnet 81, the rubber column 922 and the annular protruding ring 32 are connected together. A fixing screw 98 passes through a side circumferential through hole of a cap 822 of the second magnet and then is locked and screwed to the second magnet 82, such that the cap 822 of the second magnet and the second magnet 82 are fixed together. The cap of the second magnet 822 is made of epoxy or any kind of rubber, such that the cap 822 of the second magnet and the second magnet 82 are fixed together.

The adjustment base 70 is locked and screwed into the cap 822 of the second magnet, such that the cap 822 of the second magnet and the adjustment base 70 are fixed together. The adjustment base 70 is adjusted and rotated to correspondingly cooperate with the plug 60, the second magnet 82 and the cap of the second magnet 822, thereby adjusting and reducing the separation distance between the positions of the second magnet 82 and the first magnet 81, and further correspondingly adjusting the leaf of the hinge part to self-position at a predetermined angle.

The rubber column 922 may enable the leaf 12 of the hinge part 10 to open at an angle of 125 degrees when the leaf 12 of the hinge part 10 is opened, such that the leaf 12 of the hinge part 10 is opened at a self-positioned angle exceeding a 90-degree predetermined angle in a range of the predetermined positioning angle from 50 degrees to 180 degrees, and meanwhile the rubber column 922 is presented in an energy storage elastic state that the rubber column 922 is compressed under strong high pressure from top to bottom applied by cooperation of the annular protruding ring 32 of the fixing bar 30 and the cap 811 of the first magnet, such that the energy storage elastic state of the rubber column 922 is changed, and energy storage elastic force of the rubber column 922 is released, the rubber column 922 may strongly support and hold the annular protruding ring 32 at one end with energy storage elastic force and abut the cap 811 of the first magnet at the other end with energy storage elastic force, such that the rubber column 922 may make the leaf 12 of the hinge part 10 close back, thereby resetting the leaf 12 of the hinge part 10 to position itself at a 90-degree predetermined angular position.

The above description is only the preferred embodiment of the present disclosure, so the scope of embodiments of the present disclosure cannot be limited accordingly. That is, the equivalent changes and modifications made according to the scope of the present disclosure and the content of the description shall still belong to the scope of the present disclosure.

INDUSTRIAL PRACTICABILITY

The angle-adjustable positioning and self-closing hinge for a highly sealed door of the present disclosure overcomes problems, such as poor practicability and air leakage of the traditional ascending and descending device during rotation and connection directly by means of an upper bushing lower bushing, such that the leaf of hinge part can self-position at the start point of a positioning angle within the predetermined positioning angels; further, at any predetermined positioning angles, when the hinge part is below a position start point where the hinge part can position itself, such that the leaf of the hinge part can close itself, providing wide application prospects and good industrial applicability.

What is claimed is:

1. An angle-adjustable positioning and self-closing hinge for a sealed door, comprising a hinge part, a fixing base, a fixing bar, a threaded ring and a threaded sleeve having interior threads, a connecting sleeve, a plug, and an adjustment base, the hinge part is provided with a bushing, and a leaf is fastened to an exterior of the bushing, the fixing base is provided with another bushing, the hinge part is rotatable relative to the fixing base, and the fixing bar has an outwardly extending screw portion with threads; and wherein, the threaded sleeve resides in the bushing, and the plug is adjustably secured in the another bushing, a first magnet, a second magnet, a first spring, a cup body, a second spring and an adjustment base are coaxially arranged in the connecting sleeve between the threaded sleeve and the plug on a long axis of the hinge, and the threaded sleeve receives the screw portion of the fixing bar to secure the hinge together, the first spring abuts between the fixing bar and a front end face of the cup body, and the first magnet is axially movable with the fixing bar, the second spring abuts the plug at one end and abuts the second magnet at the other end, the second magnet is axially movable relative to the plug, the first magnet and the second magnet are arranged in the connecting sleeve such that a magnetic force attracts each of the magnets toward one another, and the adjustment base is rotated accordingly to move the plug and the bottom of the cup body to and fro along the axis, thereby adjusting and reducing separation distance between positions of the second magnet and the plug.

2. An angle-adjustable positioning and self-closing hinge for a sealed door, comprising a hinge part, a fixing base, a fixing bar and a threaded sleeve, the hinge part being provided with a bushing and a leaf fastened outside the bushing, the threaded sleeve having a thin bar which constitutes the leaf, the threaded sleeve being rotatably arranged in the bushing, the leaf being rotatable relative to the fixing bar and the fixing base, and the fixing bar has an outwardly extending screw portion with threads; and characterized in that: the angle-adjustable positioning and self-closing hinge further comprises a plug and an adjustment base, the threaded sleeve is fastened inside one end of the bushing, the plug is fastened inside the other end the bushing, and the threaded sleeve and plug are spaced apart; the fixing bar, a threaded ring, a first magnet, a second magnet, a first spring, a cup body and a second spring are provided between the threaded sleeve and plug in the bushing, and the threaded sleeve receives the screw portion of the fixing bar to secure the hinge together, a first spring abuts between the fixing bar and the first magnet, the first magnet is movable relative to the fixing bar, the second spring abuts relative to the plug at one end and abuts the second magnet at the other end, the second magnet is movable relative to the plug, the first magnet and second magnet are magnetically attracted to each other, and the adjustment base is adjusted and rotated to correspondingly cooperate with the second magnet, the plug and the bottom of the cup body, thereby adjusting and reducing separation distance between positions of the second magnet and the plug; the adjustment base is adjusted and rotated to correspondingly cooperate with the second magnet, the plug and the bottom of the cup body, thereby adjusting and reducing separation distance between positions of the second magnet and the first magnet; wherein, the fixing bar has a protruding ring, a sliding track groove is concavely arranged on a side of an outer ring of the protruding ring, and an inner ring flange of the threaded ring is convexly arranged on a front edge of an inner circumference passing through a through hole of the threaded ring, such that the inner ring flange of the threaded ring abuts inside the sliding track groove of the protruding ring, and the sliding track groove of the protruding ring correspondingly fits the inner ring flange of the threaded ring, so as to control and position axial and circumferential separation distance of the fixing bar in sliding and moving along an axis up and down relative to the threaded sleeve, and to correspondingly cooperate with the leaf of the hinge part to predetermine a positioning angle.

3. The hinge according to claim 1, further comprising a first screw and a second screw, wherein the first screw and the second screw each has a smooth section and a threaded section at an end, the smooth section of the first screw passes through the first magnet and the threaded section of the first screw is screwed on the fixing bar, and a screw head of the first screw is supported at the first magnet; and the smooth section of the second screw passes through the second magnet and the threaded section of the second screw is screwed on the plug, and a screw head of the second screw is supported at the second magnet.

4. The hinge according to claim 1, wherein the cup body is relatively movable in the bushing, the second spring abuts between the cup bottom of the cup body and the second magnet, and the adjustment base connects the cup bottom and plug for the adjustment of separation distance between the cup bottom and plug, thereby adjusting and reducing separation distance between the plug and the second magnet, and correspondingly adjusting and reducing separation distance between the second magnet and the first magnet.

5. The hinge according to claim 3, wherein the adjustment base is a third screw threaded through the plug and abutting against the bottom of the cup body.

6. The hinge according to claim 3, wherein the second spring and the second magnet are contained in the cup body, and the second magnet and the cup body move together as a single unit on the axis, and a lower portion of the first magnet is contained in and moves axially with the cup body.

7. The hinge according to claim 3, wherein an annular protruding ring secures the protruding ring to a connecting bar, and the first spring is fitted over the connecting bar and seats against the protruding ring at one end and against a pad, or O-ring, positioned on a front outer edge of the cup body at another end.

8. The hinge according to claim 5, wherein the second spring is positioned to constantly urge a protruding ring of the fixing bar and the first magnet apart, and the first screw passes through an inner ring through hole of the first magnet, an inner ring through hole of a pad, or O-ring, and the second spring and is threadedly secured to a connecting bar; the second magnet is positioned on a pad for adjustment of a leaf positioning angle, and the second screw passes through an inner ring through hole of the second magnet and an inner ring through hole of the pad and is threadedly secured to the adjustment base, such that the second magnet and the adjustment base are fastened together; an annular protruding ring secures the protruding ring to the connecting bar to define the protruding ring, an annular groove is formed at an outer ring in the annular protruding ring, an O-ring resides in the annular groove to seal and contact an interior wall of the connecting sleeve for sliding engagement with the interior wall to generate sealing damping force and resistance force in the connecting sleeve thus improving the damping force and the resistance force generated by up and down sliding and movement of the annular protruding ring within the connecting sleeve.

9. The hinge according to claim 5, wherein an front edge, provided with the screw, of the fixing bar is provided with a screw ring; a hook bar fits an inner ring through hole of a rotary ring, and a device is flatly placed on the thin rod of the threaded sleeve; the threaded sleeve and the thin rod of the threaded sleeve have a tension spring through hole, such that the tension spring is installed in the tension spring through hole; the tension spring is fixedly connected with a front hook and a rear hook at two ends, the rear hook of the tension spring hooks on the screw ring, and the front hook of the tension spring hooks on the hook bar, such that the tension spring controls distance of the up and down sliding and moving of the screw of the fixing bar unchanged, thereby correspondingly cooperating with the leaf of hinge part to predetermine positioning angle; the protruding ring of the fixing bar is concavely provided with a protruding ring sliding track groove on a side of an outer ring, and an inner ring flange of the threaded ring is protrudingly arranged on a an inner circumferential front edge passing through a through hole of the threaded ring, such that the inner ring flange of the threaded ring abuts inside the protruding ring sliding track groove, and the sliding track groove of the protruding ring correspondingly fits the inner ring flange of the threaded ring, so as to control and limit axial and spread separation distance of the fixing rod in sliding and moving along an axis up and down relative to the threaded sleeve.

10. The hinge according to claim 2, further comprising a first screw and a second screw, wherein the first screw and the second screw both have a smooth section and a threaded section at an end, the smooth section of the first screw passes through the first magnet and the threaded section of the first screw is screwed on the fixing rod, and a screw head of the first screw is supported at the first magnet; and the smooth section of the second screw passes through the second magnet and the threaded section of the second screw is screwed on the plug, and a screw head of the second screw is supported at the second magnet.

11. The hinge according to claim 2, wherein the cup body is relatively movable in the bushing, the second spring abuts between the cup bottom of the cup body and the second magnet, and the adjustment base connects the cup bottom and plug for the adjustment of separation distance between the cup bottom and plug, thereby adjusting and reducing separation distance between the plug and the second magnet, and correspondingly adjusting and reducing separation distance between the second magnet and the first magnet.

12. The hinge according to claim 3, wherein the cup body is relatively movable in the bushing, the second spring abuts between the cup bottom of the cup body and the second magnet, and the adjustment base connects the cup bottom and plug for the adjustment of separation distance between the cup bottom and plug, thereby adjusting and reducing separation distance between the plug and the second magnet, and correspondingly adjusting and reducing separation distance between the second magnet and the first magnet.

13. The hinge according to claim 5, wherein the cup body is relatively movable in the bushing, the second spring abuts between the cup bottom of the cup body and the second magnet, and the adjustment base connects the cup bottom and plug for the adjustment of separation distance between the cup bottom and plug, thereby adjusting and reducing separation distance between the plug and the second magnet, and correspondingly adjusting and reducing separation distance between the second magnet and the first magnet.

* * * * *